US006167676B1

(12) United States Patent
Shipman et al.

(10) Patent No.: US 6,167,676 B1
(45) Date of Patent: Jan. 2, 2001

(54) METHOD OF CONNECTING PARTITIONS

(75) Inventors: David A. Shipman, Grand Rapids, MI (US); Benjamin G. Shaw, Denver, CO (US); Charles A. Seiber, Atherton; Don S. Minami, Monte Sereno, both of CA (US); David D. McClanahan, Harleysville, PA (US); Robert J. Luchetti, Cambridge, MA (US); Christopher O. Lada, Palo Alto; Phillip M. Hobson, Los Altos, both of CA (US); James B. Eldon, III, Barto, PA (US); Gregg R. Draudt, Stow, MA (US)

(73) Assignee: Steelcase Development, Inc., Grand Rapids, MI (US)

( * ) Notice: Under 35 U.S.C. 154(b), the term of this patent shall be extended for 0 days.

(21) Appl. No.: 09/335,373

(22) Filed: Jun. 17, 1999

Related U.S. Application Data

(63) Continuation of application No. 09/067,731, filed on Apr. 28, 1998, now Pat. No. 6,044,612, which is a continuation of application No. 08/579,614, filed on Dec. 26, 1995, now Pat. No. 5,746,035, which is a continuation-in-part of application No. 08/367,802, filed on Dec. 30, 1994, now Pat. No. 5,746,034.

(51) Int. Cl.[7] ..... E04G 21/00

(52) U.S. Cl. ..... 52/745.1; 52/745.13

(58) Field of Search ..... 52/239, 36.1, 36.4, 52/36.5, 36.6, 745.1, 745.13; 312/223.3, 245, 246

(56) References Cited

U.S. PATENT DOCUMENTS

| | | |
|---|---|---|
| Re. 034,381 | 9/1993 | Barnes . |
| D. 350,401 | 9/1994 | Kok . |
| 726,732 | 4/1903 | Nelson . |

(List continued on next page.)

FOREIGN PATENT DOCUMENTS

| | | |
|---|---|---|
| 73417 | 5/1987 | (AU) . |
| 581818 | 3/1989 | (AU) . |
| 2623814 | 12/1977 | (DE) . |

(List continued on next page.)

OTHER PUBLICATIONS

Exhibit A is a brochure entitled *Knoll–Hannah Desk System*, 18 pages, dated Oct. 1986.

Exhibit B is a brochure entitled *Knoll–Hannah Desk System*, 13 pages, undated but published in 1986.

Exhibit C is a publication entitled *Knoll–Hannah Desk System–Electrical Assembly Guide*, 12 pages, undated but published in 1986.

Exhibit D is a publication entitled *Knoll–Hannah Desk System–Assembly Guide*, 12 pages, undated but published in 1986.

*Primary Examiner*—Michael Safavi
(74) *Attorney, Agent, or Firm*—Price Heneveld Cooper Dewitt & Cooper

(57) ABSTRACT

A freestanding portable partition panel system is provided for open office spaces and the like. Each panel includes a skeleton-like frame having two vertical uprights positioned adjacent opposite side edges thereof, and at least two pairs of horizontal stringers attached to the outer faces of the uprights in a vertically spaced-apart relationship to rigidly interconnect the same. One or more horizontal rows of slots are defined in each of the stringers. Cover panels are detachably mounted thereon to provide ready access to the frame. The cover panels permit access to the slots, and special off-module connectors with hooks for engaging the slots are provided for interconnecting adjacent panels in off-module positions. The hooks of the connectors are engaged with selected slots to hold a first partition panel perpendicular to a second partition panel in an off-module position on its face.

27 Claims, 29 Drawing Sheets

U.S. PATENT DOCUMENTS

| | | |
|---|---|---|
| 735,618 | 8/1903 | Tannewitz . |
| 1,724,821 | 8/1929 | Bohnsack . |
| 1,876,528 | 9/1932 | Walters . |
| 1,959,135 | 5/1934 | Miller . |
| 1,990,259 | 2/1935 | Walters . |
| 2,044,637 | 6/1936 | Ross . |
| 2,049,278 | 7/1936 | Toussaint . |
| 2,121,213 | 7/1938 | Small . |
| 2,232,510 | 2/1941 | Buckham . |
| 2,576,865 | 11/1951 | Vanderveld . |
| 2,741,449 | 4/1956 | Heselov . |
| 2,849,756 | 9/1958 | Gundel et al. . |
| 3,001,615 | 9/1961 | Ries . |
| 3,045,784 | 7/1962 | Hasekamp . |
| 3,065,575 | 11/1962 | Ray . |
| 3,066,770 | 12/1962 | Millard . |
| 3,087,702 | 4/1963 | Anderson . |
| 3,090,164 | 5/1963 | Nelsson . |
| 3,097,822 | 7/1963 | Attwood . |
| 3,101,817 | 8/1963 | Radek . |
| 3,135,026 | 6/1964 | Fridolph . |
| 3,180,459 | 4/1965 | Liskey, Jr. . |
| 3,195,698 | 7/1965 | Codrea . |
| 3,199,822 | 8/1965 | Ruhnke . |
| 3,290,846 | 12/1966 | Mader et al. . |
| 3,353,314 | 11/1967 | Melcher . |
| 3,370,391 | 2/1968 | Dupuis et al. . |
| 3,378,977 | 4/1968 | Vervloet . |
| 3,391,795 | 7/1968 | Finlayson . |
| 3,392,497 | 7/1968 | Cushman . |
| 3,400,831 | 9/1968 | De Niet . |
| 3,412,515 | 11/1968 | Finon . |
| 3,425,568 | 2/1969 | Albright . |
| 3,500,894 | 3/1970 | Pofferi . |
| 3,514,794 | 6/1970 | Pofferi . |
| 3,514,883 | 6/1970 | Albright . |
| 3,561,182 | 2/1971 | Madl, Jr. . |
| 3,565,381 | 2/1971 | Oliver . |
| 3,571,987 | 3/1971 | Anderson . |
| 3,686,805 | 8/1972 | Pofferi . |
| 3,705,002 | 12/1972 | Varlonga . |
| 3,745,732 | 7/1973 | Pritchard . |
| 3,798,865 | 3/1974 | Curtis . |
| 3,811,575 | 5/1974 | Boegehold . |
| 3,834,093 | 9/1974 | Tacke . |
| 3,958,386 | 5/1976 | Pollock . |
| 4,018,167 | 4/1977 | Spangler . |
| 4,121,645 | 10/1978 | Behr . |
| 4,198,913 | 4/1980 | Haworth . |
| 4,204,375 | 5/1980 | Good . |
| 4,224,769 | 9/1980 | Ball et al. . |
| 4,255,611 | 3/1981 | Propst et al. . |
| 4,356,674 | 11/1982 | Propst et al. . |
| 4,378,925 | 4/1983 | Griffin . |
| 4,391,069 | 7/1983 | Vermillion . |
| 4,391,073 | 7/1983 | Mollenkopf et al. . |
| 4,481,749 | 11/1984 | Stirling . |
| 4,512,122 | 4/1985 | Berkowitz . |
| 4,535,577 | 8/1985 | Tenser et al. . |
| 4,567,698 | 2/1986 | Morrison . |
| 4,567,699 | 2/1986 | McClellan . |
| 4,571,906 | 2/1986 | Ashton . |
| 4,578,914 | 4/1986 | Staples . |
| 4,619,486 | 10/1986 | Hannah et al. . |
| 4,625,483 | 12/1986 | Zacky et al. . |
| 4,631,881 | 12/1986 | Charman . |
| 4,651,484 | 3/1987 | Rutkowski . |
| 4,656,211 | 4/1987 | Gallant et al. . |
| 4,660,339 | 4/1987 | Paz . |
| 4,662,135 | 5/1987 | Tanikawa . |
| 4,662,136 | 5/1987 | Tanikawa . |
| 4,685,255 | 8/1987 | Kelley . |
| 4,709,454 | 12/1987 | Barnes . |
| 4,709,517 | 12/1987 | Mitchell . |
| 4,712,336 | 12/1987 | Backer . |
| 4,716,699 | 1/1988 | Crossman et al. . |
| 4,730,740 | 3/1988 | Winster et al. . |
| 4,771,583 | 9/1988 | Ball et al. . |
| 4,795,355 | 1/1989 | Dorn et al. . |
| 4,828,005 | 5/1989 | Notley . |
| 4,831,791 | 5/1989 | Ball . |
| 4,833,848 | 5/1989 | Guerin . |
| 4,833,849 | 5/1989 | Williams et al. . |
| 4,837,988 | 6/1989 | Menchetti et al. . |
| 4,841,699 | 6/1989 | Wilson et al. . |
| 4,862,659 | 9/1989 | Wilson et al. . |
| 4,876,835 | 10/1989 | Kelley et al. . |
| 4,883,330 | 11/1989 | Armstrong et al. . |
| 4,893,963 | 1/1990 | Le Goff . |
| 4,905,428 | 3/1990 | Sykes . |
| 4,918,886 | 4/1990 | Benoit et al. . |
| 4,928,467 | 5/1990 | Hintsa . |
| 4,932,177 | 6/1990 | Hinden . |
| 4,934,858 | 6/1990 | Beaulieu . |
| 4,942,713 | 7/1990 | Jackson . |
| 4,942,805 | 7/1990 | Hellwig et al. . |
| 4,944,122 | 7/1990 | Wendt . |
| 4,947,601 | 8/1990 | McGuire . |
| 4,983,065 | 1/1991 | Spath . |
| 4,991,368 | 2/1991 | Amstutz . |
| 5,005,325 | 4/1991 | Dull . |
| 5,025,603 | 6/1991 | Johnson . |
| 5,038,534 | 8/1991 | Pollock . |
| 5,038,539 | 8/1991 | Kelley et al. . |
| 5,040,345 | 8/1991 | Gilmour . |
| 5,048,243 | 9/1991 | Ward . |
| 5,052,565 | 10/1991 | Zachrei . |
| 5,054,255 | 10/1991 | Maninfior . |
| 5,062,246 | 11/1991 | Sykes . |
| 5,086,597 | 2/1992 | Kelley et al. . |
| 5,094,053 | 3/1992 | Militzer . |
| 5,117,599 | 6/1992 | Voss . |
| 5,129,202 | 7/1992 | Payne et al. . |
| 5,134,826 | 8/1992 | La Roche et al. . |
| 5,142,832 | 9/1992 | Branham, Sr. et al. . |
| 5,155,955 | 10/1992 | Ball et al. . |
| 5,174,086 | 12/1992 | Payne et al. . |
| 5,175,969 | 1/1993 | Knauf et al. . |
| 5,176,462 | 1/1993 | Chen . |
| 5,177,917 | 1/1993 | del Castillo Von Haucke . |
| 5,184,441 | 2/1993 | Balfanz, Jr. . |
| 5,187,908 | 2/1993 | Losensky . |
| 5,203,132 | 4/1993 | Smolik . |
| 5,209,035 | 5/1993 | Hodges et al. . |
| 5,214,889 | 6/1993 | Nienhuis . |
| 5,214,890 | 6/1993 | Levitan et al. . |
| 5,220,871 | 6/1993 | Grund et al. . |
| 5,239,798 | 8/1993 | Saito . |
| 5,241,796 | 9/1993 | Hellwig et al. . |
| 5,277,005 | 1/1994 | Hellwig et al. . |
| 5,277,007 | 1/1994 | Hellwig et al. . |
| 5,287,666 | 2/1994 | Frascaroli et al. . |
| 5,309,686 * | 5/1994 | Underwood et al. ..... 52/36.5 |
| 5,341,615 | 8/1994 | Hodges et al. . |
| 5,377,461 | 1/1995 | DeGrada et al. . |
| 5,377,466 | 1/1995 | Insalaco et al. . |
| 5,394,658 | 3/1995 | Schreiner et al. . |
| 5,394,668 | 3/1995 | Lim . |
| 5,400,560 | 3/1995 | Hellwig et al. . |
| 5,406,760 | 4/1995 | Edwards . |
| 5,417,020 | 5/1995 | Dobija . |

| | | |
|---|---|---|
| 5,426,904 | 6/1995 | Gilmore . |
| 5,437,426 | 8/1995 | MacDonald . |
| 5,488,808 | 2/1996 | Cahill et al. . |
| 5,490,357 | 2/1996 | Lin . |

FOREIGN PATENT DOCUMENTS

| | | | |
|---|---|---|---|
| 4219717 | 12/1993 | (DE) . | |
| 1055464 | 2/1954 | (FR) . | |
| 8112517 | 12/1982 | (FR) . | |
| 2518192 | 6/1983 | (FR) . | |
| 714002 | 8/1954 | (GB) . | |
| 1098851 | 11/1968 | (GB) . | |
| 2060022 * | 4/1981 | (GB) | 52/36.5 |
| 1600990 | 10/1981 | (GB) . | |
| 2212186 | 7/1989 | (GB) . | |
| 7513200 | 5/1976 | (NL) . | |
| 2010112 | 3/1994 | (RU) . | |

* cited by examiner

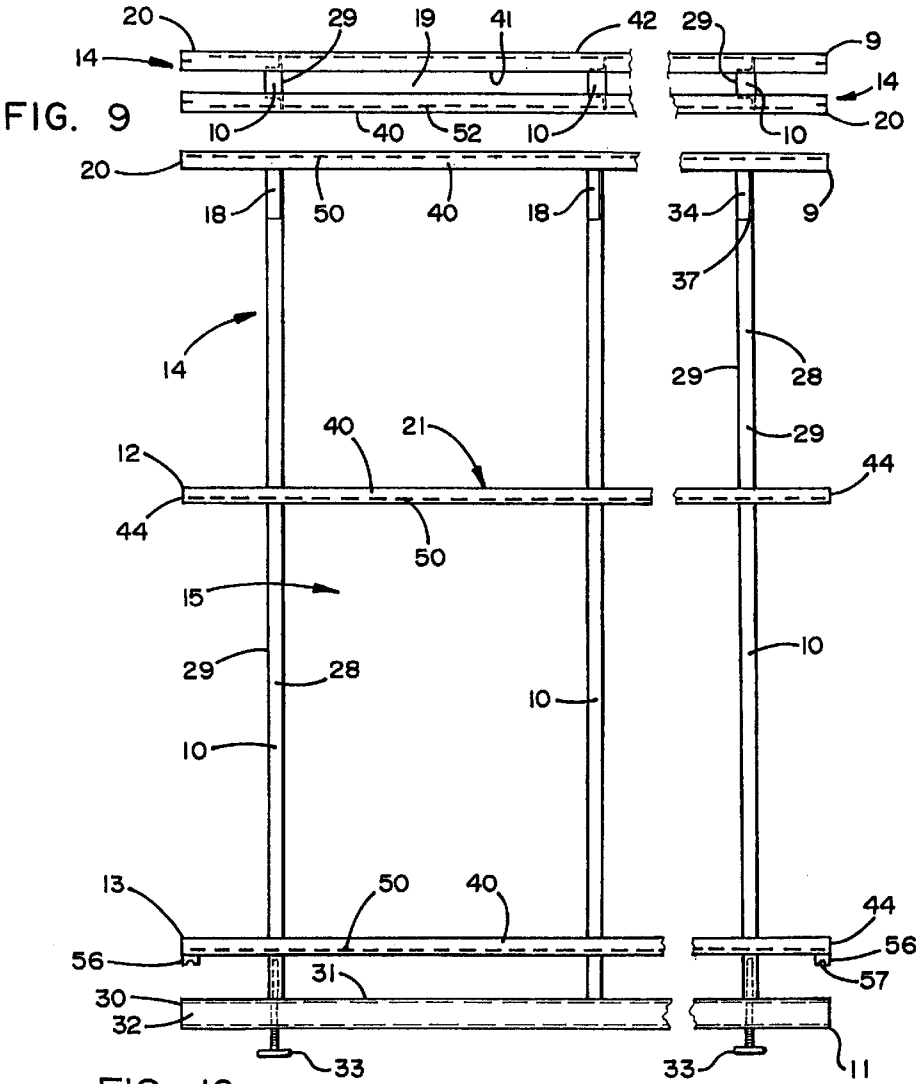
FIG. 9
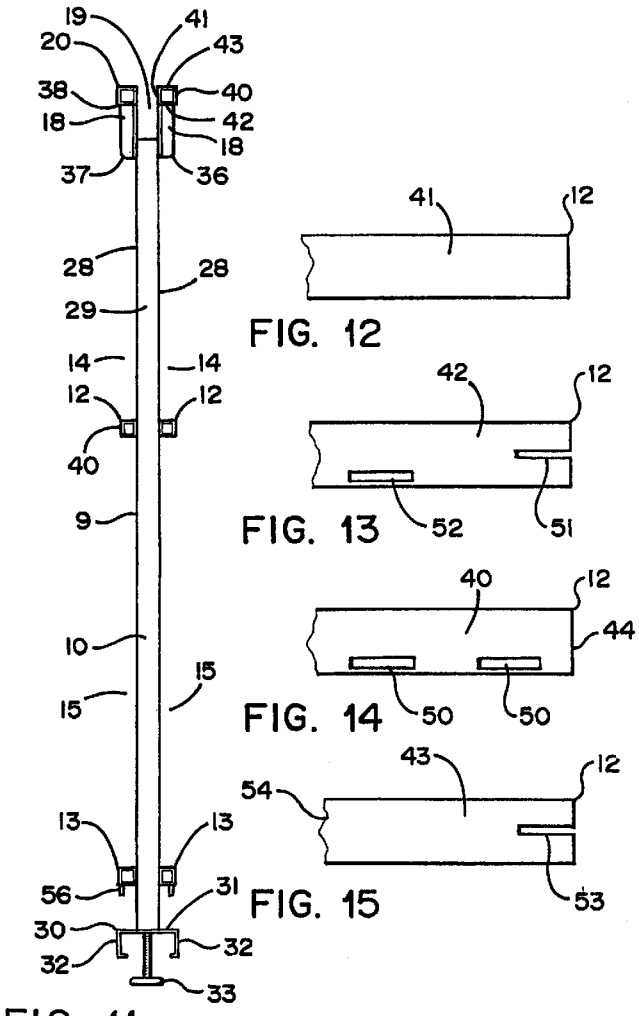
FIG. 10
FIG. 11
FIG. 12
FIG. 13
FIG. 14
FIG. 15

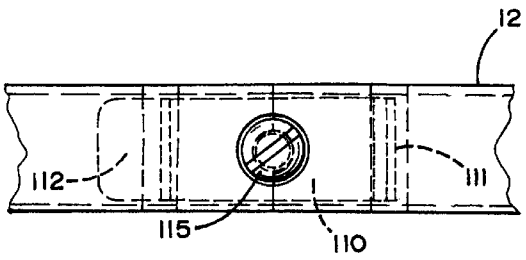
FIG. 28
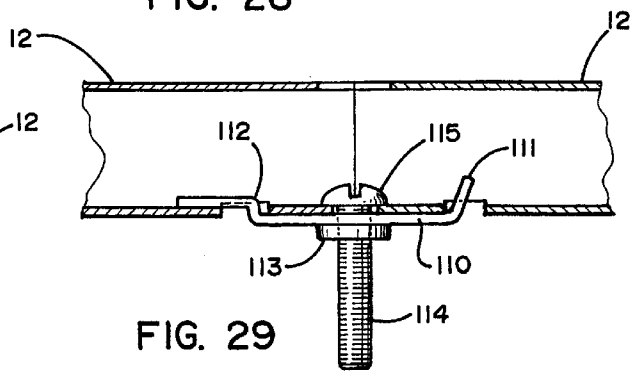
FIG. 29
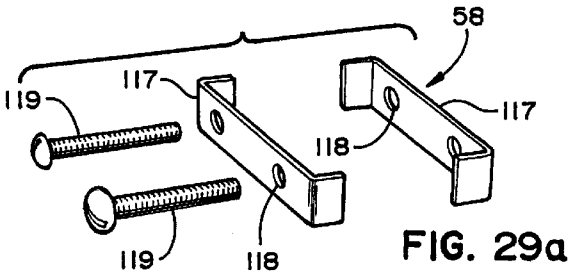
FIG. 29a
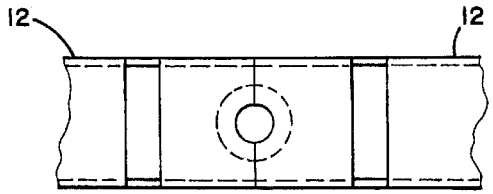
FIG. 24a
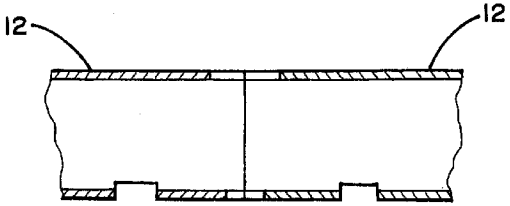
FIG. 25
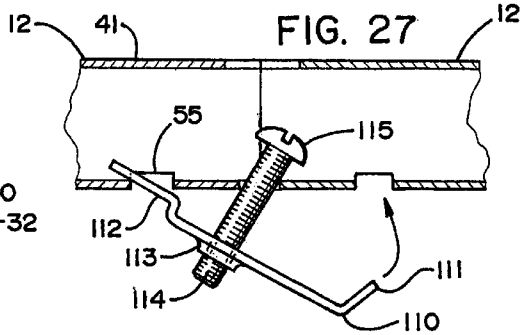
FIG. 26
FIG. 27
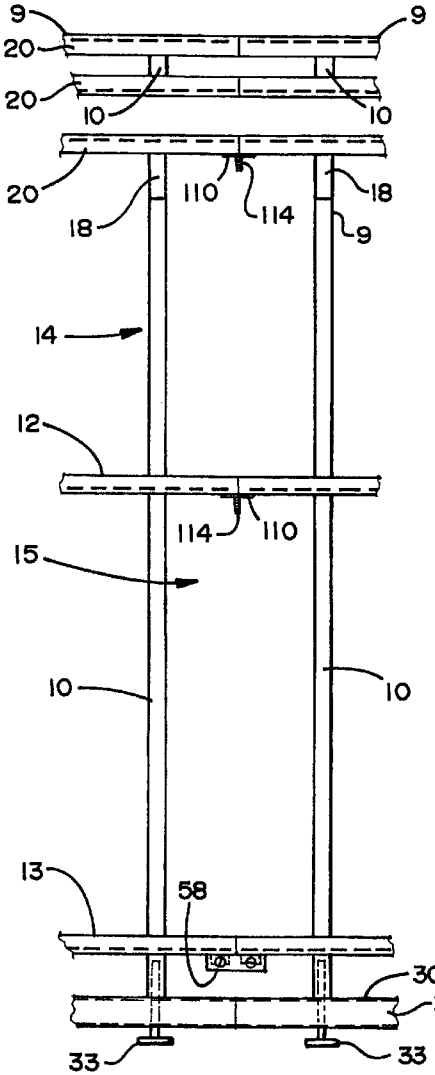
FIG. 24b

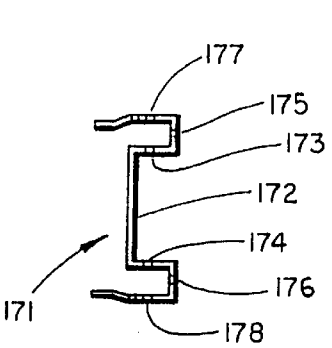
FIG. 38
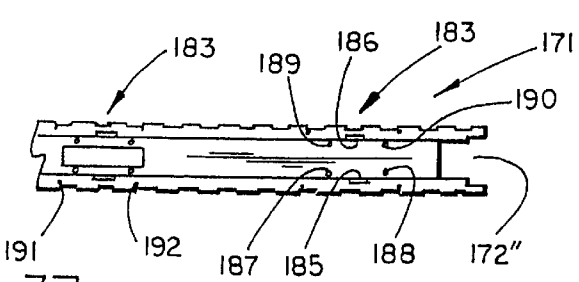
FIG. 37
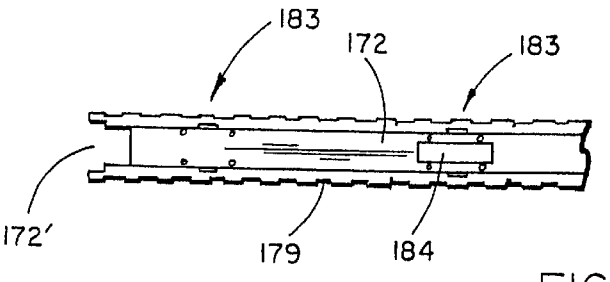
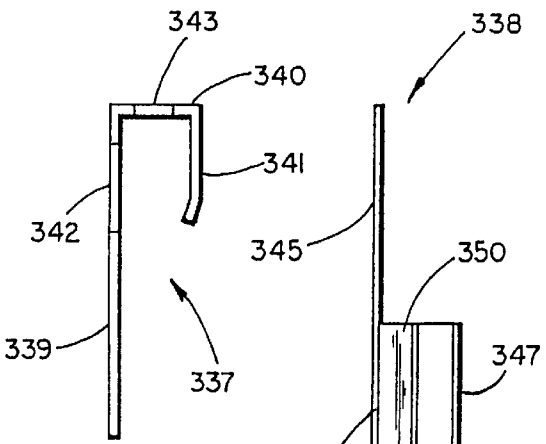
FIG. 66
FIG. 64
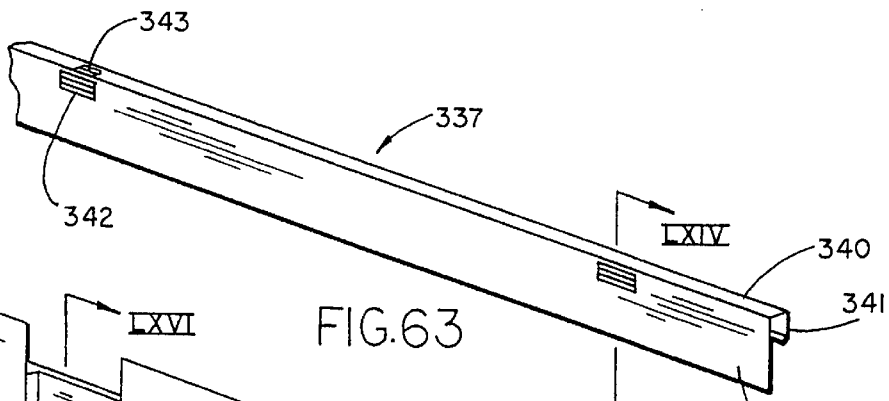
FIG. 63
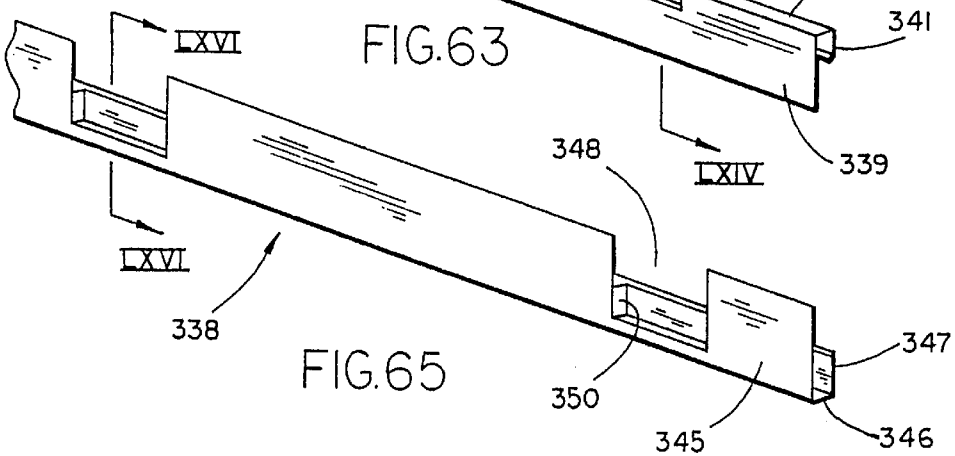
FIG. 65

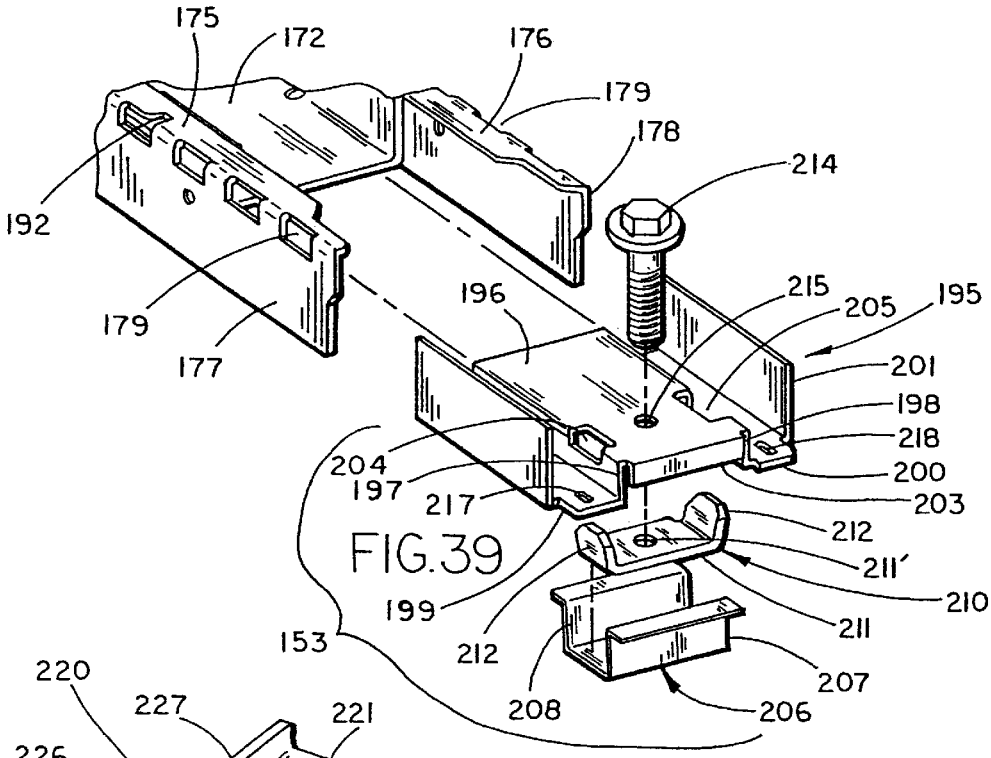
FIG.39
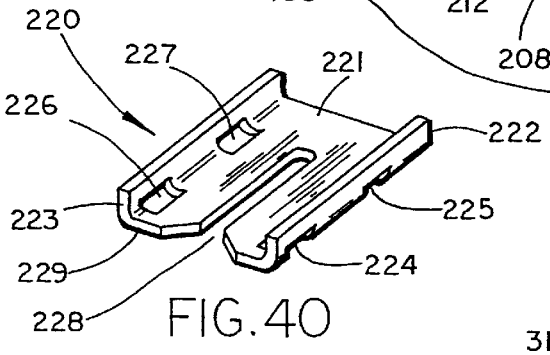
FIG.40
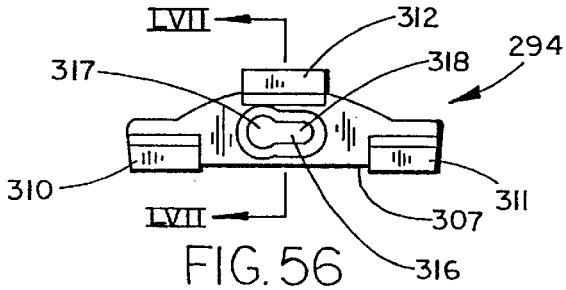
FIG.56
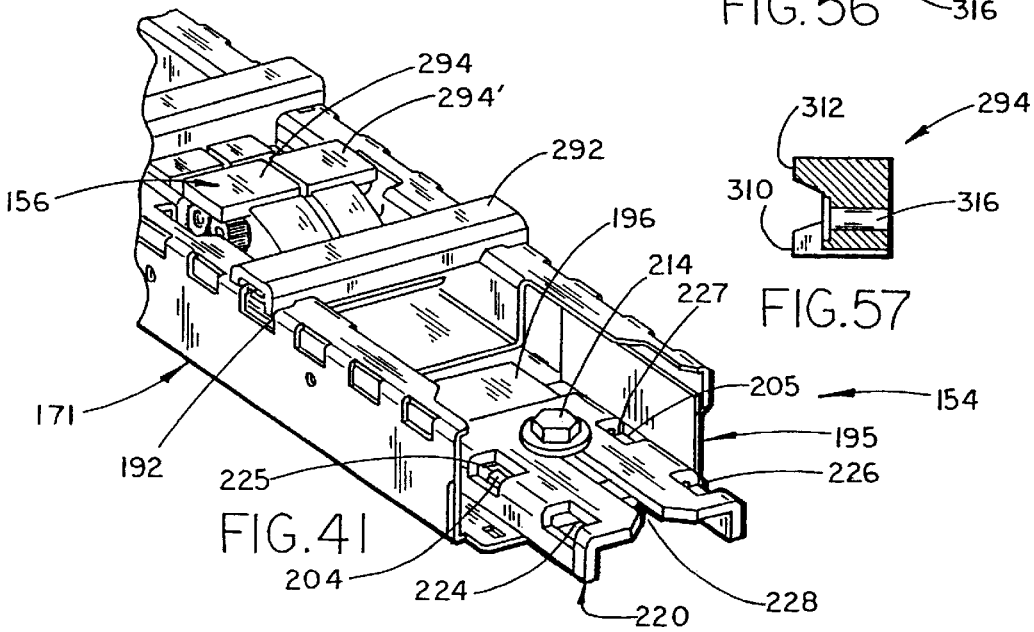
FIG.41
FIG.57

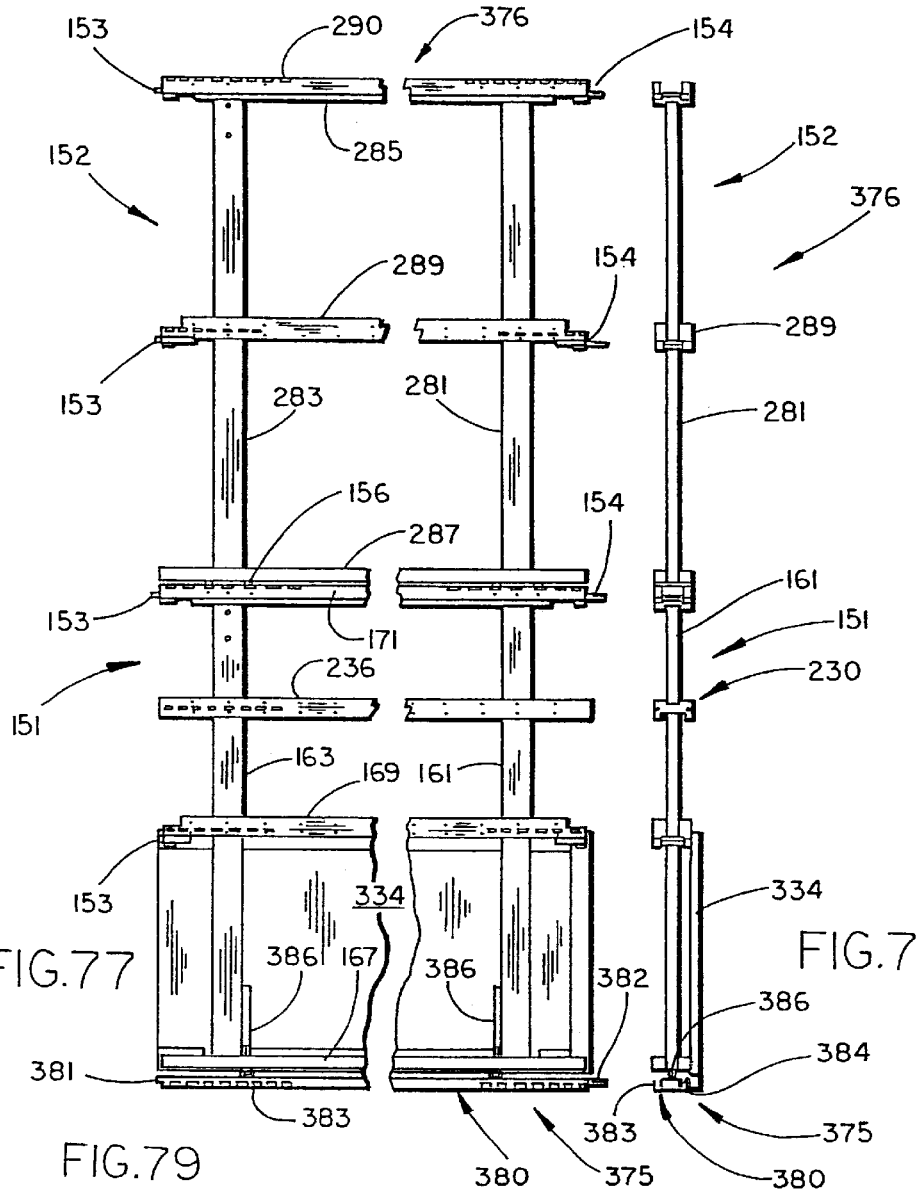
FIG.77
FIG.78
FIG.79
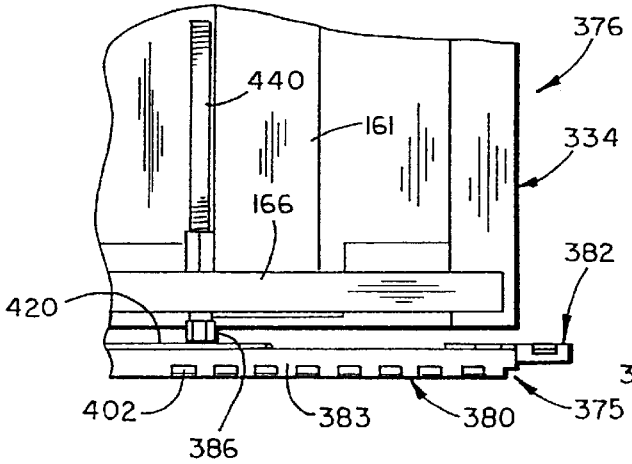
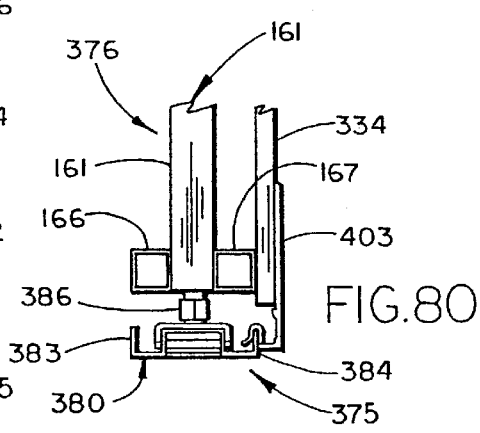
FIG.80

METHOD OF CONNECTING PARTITIONS

CROSS-REFERENCE TO RELATED APPLICATIONS

The present application is a continuation of co-assigned U.S. patent application Ser. No. 09/067,731, filed Apr. 28 1998, now U.S. Pat. No. 6,044,612 entitled Connection System for Partitions, which is a continuation of Ser. No. 08/579,614 filed Dec. 26, 1995, now U.S. Pat. No. 5,746,035, issued May 5, 1998, entitled Partition System, which is a continuation-in-part of Ser. No. 08/367,802 filed Dec. 30, 1994, now U.S. Pat. No. 5,746,034, issued May 5, 1998, entitled Portable Partition System, the entire contents of which are incorporated herein by reference. The present application further is related to the following commonly assigned U.S. patents and applications: U.S. Pat. No. 5,740,650, issued Apr. 21, 1998, entitled Partition System; U.S. Pat. No. 5,784,843, issued Jul. 28, 1998, entitled Integrated Prefabricated Furniture System for Fitting-Out Open Plan Building Space; U.S. Pat. No. 5,809,708, issued Sep. 22, 1998, entitled Integrated Prefabricated Furniture System for Fitting-Out Open Plan Building Space; U.S. Pat. No. 5,816,001, issued Oct. 6, 1998, entitled Partition Construction Including Interconnection System and Removable Covers; application Ser. No. 08/701,664, filed Aug. 22, 1996, entitled Reconfigurable System for Subdividing Building Space and Having Minimal Footprint; and application Ser. No. 08/970,251, filed Nov. 13, 1997, entitled Partition Construction.

BACKGROUND OF THE INVENTION

The present invention relates to partition arrangements for open office spaces and the like, and in particular to a connection system for interconnecting freestanding portable panels in off-module positions where one panel is oriented at an angle to and abuts a face of another panel.

Portable partition systems for open office spaces and other similar settings are well known in the art. Individual partition panels are interconnected in different configurations to form separate offices, work stations, or work settings. The partition panels are extremely durable, and can be readily disassembled and reassembled into alternative configurations to meet the ever-changing needs of the user. Examples of such partition systems are provided in U.S. Pat. Nos. 3,822,146; 3,831,330; and 4,144,924, which are owned by Steelcase Inc., the assignee of the present application.

The finishing or fitting-out of building spaces for offices, medical treatment facilities, and other similar environments has become a very important aspect of effective space planning and layout. Work patterns, technology, and business organizations are constantly evolving and changing. The building space users require products that facilitate change at lower costs. Space planning is no longer a static problem. Changing technology and changing work processes demand that a design and installation be able to support and anticipate change. However, often the existing partition systems are limited in their ability to be reconfigured, thus limiting the number and size of different office arrangements that can be constructed, and limiting the speed with which changes can be made.

Consequently, a fully integrated prefabricated furnishing system has been developed to finish or fit-out both new and existing open plan building spaces. One requirement of this integrated furnishing system is a freestanding portable partition system that has enhanced utility carrying capabilities while still facilitating quick and accurate reconfiguration.

Concurrently, it is desired to provide a panel connection system having increased flexibility for interconnecting reconfigurable partition panels in office layouts. For example, a partition panel connection system is desired that allows use of standardized base partition panels and that facilitates accurate positioning of the partition panels, even where the dimensions of the office layouts are not multiples of the base partition panel width dimension. Additional functionality of the connection system is also desired, such as to permit removing a partition panel from attachment to another panel without having to disassemble both panels.

Thus, a wall construction solving the aforementioned problems and providing the aforementioned functionalities is desired.

SUMMARY OF THE INVENTION

In one aspect of the present invention, a method is provided for attaching furniture components to an existing partition having a horizontal row of slots that extend along a horizontal/lateral direction parallel a face of the existing partition. The method includes a step of providing bracketry having hooks movable between an installation position where the hooks define a compact shape permitting selective insertion into the horizontal row of slots in the existing partition, and an interlocked position where the hooks define a modified shape for securely engaging selected ones of the slots. The method further includes steps of positioning the bracketry for insertion including moving the hooks to the installation position, manipulating the bracketry to orient the hooks, and inserting the hooks into engagement with selected ones of the slots, moving the hooks in a horizontal/lateral direction parallel the face of the existing partition to the interlocked position, and fixing the hooks in the interlocked position.

In another aspect of the present invention, a method is provided for attaching an adjustable partition to an existing partition, where the existing partition defines a horizontal row of slots that extend horizontally/laterally across the existing partition. The method includes positioning a vertical side edge of the adjustable partition against a face of the existing partition at a selected location between vertical side edges of the existing partition, providing brackets with hooks configured to engage selected ones of the slots, and attaching the brackets to the vertical side edges of the adjustable partition with the hooks facing horizontally/laterally in opposite directions and engaging the selected slots that correspond to the selected location, whereby the adjustable partition is securely attached and accurately positioned at the selected location.

In another aspect of the present invention, a method for attaching a furniture unit to a partition having a frame with a horizontal row of slots, includes a step of providing a bracket having a hook constructed for insertion into a selected one of the slots in the horizontal row of slots of the partition and to move horizontally between an installation position and an interlocked position. The method further includes steps of selectively inserting the hook into a selected one of the slots in the horizontal row of slots of the partition, with the hook being positioned in the installation position, moving the hook horizontally/laterally to the interlocked position, attaching the bracket to the furniture unit, and securing the hook in the interlocked position.

In yet another aspect of the present invention, a method of connecting partition panels includes a step of providing a first partition panel including a partition frame having upper and lower horizontal frame members, at least one of which includes a horizontal row of horizontally spaced and aligned discrete site locators, including at least one discrete site locator positioned between vertical side edges of the partition frame. The discrete site locators are configured and adapted to locate an off-module-located second partition panel along the partition frame at any one of a number of known locations characteristically without the need to measure to accurately locate the second partition panel. The method further includes a step of accurately locating an off-module-located second partition panel on the first partition panel relative to a selected one of the discrete site locators.

These and other advantages of the invention will be further understood and appreciated by those skilled in the art by reference to the following written specification, claims, and appended drawings.

BRIEF DESCRIPTION OF THE DRAWINGS

FIG. 9 is a fragmentary, top plan view of the base panel frame;

FIG. 10 is a fragmentary, front elevational view of the base panel frame;

FIG. 11 is a side elevational view of the base panel frame;

FIG. 12 is a fragmentary, top plan view of a horizontal stringer portion of the base panel frame;

FIG. 13 is a fragmentary, bottom plan view of the horizontal stringer shown in FIG. 12;

FIG. 14 is a fragmentary, front elevational view of the stringer shown in FIGS. 12 and 13;

FIG. 15 is a fragmentary, rear elevational view of the horizontal stringer shown in FIGS. 12–14.

FIG. 24*a* is a fragmentary, top panel view of a pair of partition panels interconnected in an in-line or side-by-side relationship;

FIG. 24*b* is a fragmentary, front elevational view of the in-line partition panels shown in FIG. 24*a;*

FIG. 25 is an enlarged, fragmentary top plan view of adjacent horizontal stringers in the in-line partition panels shown in FIGS. 24*a* and 24*b;*

FIG. 26 is a vertical cross-sectional view of the adjacent horizontal stringers in the in-line panels of FIG. 25, shown before installation of a panel-to-panel clip;

FIG. 27 is a vertical cross-sectional view of the in-line horizontal stringers shown in FIG. 27, with a panel-to-panel clip shown partially installed therein;

FIG. 28 is a fragmentary, top plan view of the in-line horizontal stringers shown in FIG. 27, with the panel-to-panel connector clip shown fully installed;

FIG. 29 is a fragmentary, vertical cross-sectional view of the in-line horizontal stringers shown in FIG. 27, with the panel-to-panel connector clip shown fully installed;

FIG. 29*a* is a perspective view of a panel-to-panel base clamp;

FIG. 37 is a plan view of the horizontally extending top frame member of the space frame shown in FIG. 36;

FIG. 38 is an end view of the top frame member shown in FIG. 37;

FIG. 39 is a fragmentary exploded perspective view of an end of the top frame member shown in FIG. 35, including the first in-line connector attached thereto;

FIG. 40 is a perspective view of a telescopeable bracket of a second in-line connector shown in FIG. 35;

FIG. 41 is a fragmentary perspective view of the other end of the top frame member shown in FIG. 35, including the second in-line connector attached thereto;

FIG. 56 is a front view of a clamping member shown in FIG. 55;

FIG. 57 is a side cross-sectional view taken along the plane LVII—LVII in FIG. 56;

FIG. 63 is a fragmentary perspective view of the top member of the marginal frame of the cover shown in FIG. 62;

FIG. 64 is an enlarged cross-sectional view taken along the plane LXIV—LXIV in FIG. 63;

FIG. 65 is a fragmentary perspective view of the bottom member of the marginal frame of the cover shown in FIG. 62;

FIG. 66 is an enlarged cross-sectional view taken along the plane LXVI—LXVI in FIG. 65;

FIGS. 77 and 78 are side and end views of a wall construction including a floor-engaging channel, a base panel, and a stacking panel, each including the in-line connectors shown in FIGS. 39–41;

FIGS. 79 and 80 are enlarged side and end views of lower parts of FIGS. 77 and 78, respectively;

DETAILED DESCRIPTION OF THE PREFERRED EMBODIMENTS

Figure 1:
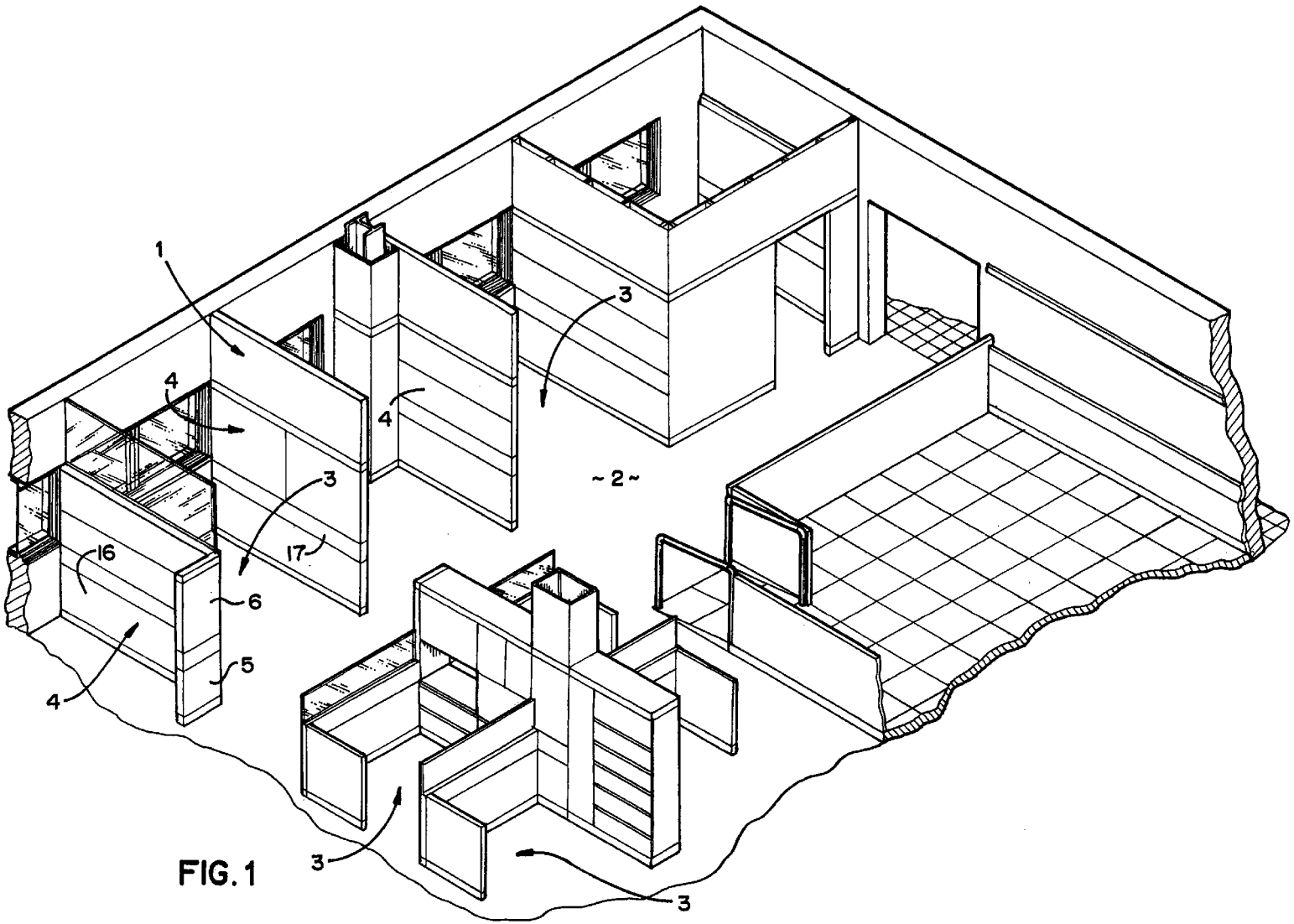
FIG. 1 is a perspective view of an integrated prefabricated furniture system, which includes a partition panel and related system embodying the present invention.
Figure 2:
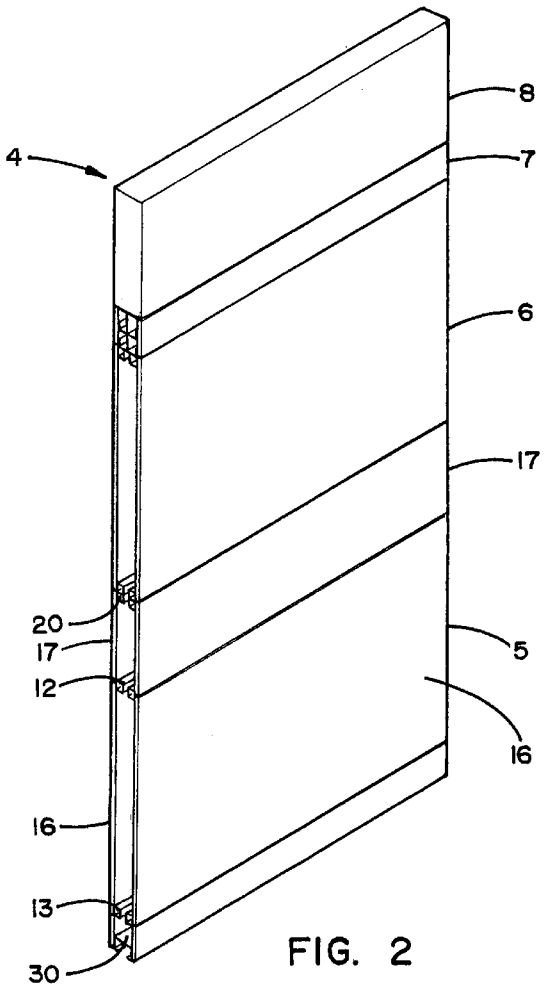
FIG. 2 is a perspective view of a partition panel embodying the present invention.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
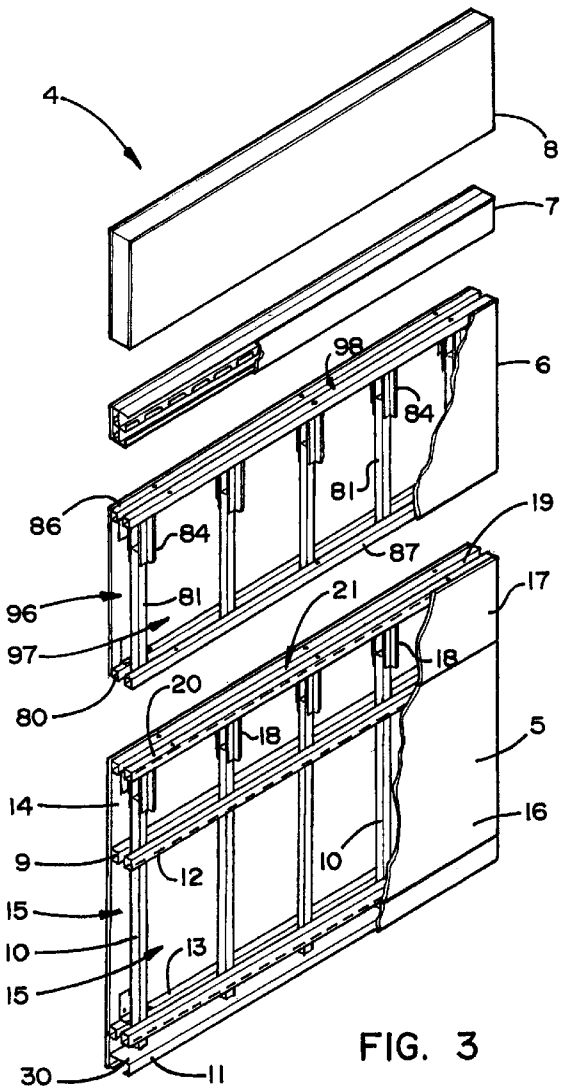
FIG. 3 is an exploded, perspective view of the partition panel wherein portions thereof have been broken away to reveal internal construction.

The reference numeral 1 (FIG. 1), generally designates a freestanding portable partition system that is designed for use in conjunction with open office spaces 2, and other similar environments to form a plurality of work settings or work stations 3. Partition system 1 includes a plurality of similar modular panels 4 (FIGS. 2 and 3), which are interconnected so as to define the desired work stations 3. One such modular panel 4 is illustrated in FIGS. 2 and 3, and includes a base panel 5, a stacker panel 6, an expressway raceway 7, and a transom 8, which are stacked vertically on top of one another.

The base panel 5 (FIG. 3) includes a skeleton-like internal frame 9 having at least two vertical uprights 10 positioned adjacent an opposite side edge thereof. A foot 11 extends downwardly from the bottom of frame 9 to abuttingly support base panel 5 on a floor surface. Two pairs of horizontal stringers 12 and 13 are attached to the outer faces of uprights 10 in a vertically spaced-apart relationship to rigidly interconnect the same, and define therebetween two horizontal raceway cavities 14 and 15, which open to the opposite side faces of frame 9 and extend continuously between the opposite side edges thereof, such that when like base panels 5 are interconnected side-by-side, the open ends of adjacent raceway cavities 14 and 15 are aligned and communicate. Cover panels 16 enclose at least those portions of the frame side faces disposed between stringers 12 and 13, and are detachably mounted thereon to provide ready access to the raceway cavities 14 and 15 and permit lay-in wiring therealong.

Each of the illustrated vertical uprights 10 (FIGS. 9–11) includes a pair of arms 18, which are attached to the outer faces thereof, and extend upwardly from upper ends thereof to define yoke-shaped receptacles 19 for receiving drop-in wiring therein. A third pair of horizontal stringers 20 is attached to the upper ends of arms 18 and extends generally parallel and coplanar with associated stringers 12 and 13. Each pair of stringers 12, 13, and 20 is spaced mutually laterally apart by the associated uprights 10, so as to define a vertical raceway cavity 21 positioned intermediate the two horizontal raceway cavities 14 and 15.

The illustrated base panel frame 9 (FIGS. 9–15) has an open, skeleton-like construction, which is preferably provided in a variety of different widths to accommodate various applications. However, in each illustrated embodiment of base panel 5, the horizontal stringers 12, 13, and 20 are substantially longer than the vertical uprights 10, such that each base panel 5 has a horizontally elongated elevational shape or datum. The base panel frame 9 illustrated in FIG. 3 includes a total of five vertical uprights 10, each of which has a substantially identical, square tubular construction comprising opposite side faces 28 (FIGS. 9–15) oriented toward the opposite sides of base panel 5, and opposite end faces 29 oriented toward the opposite end edges of base panel 5. The lower ends of vertical uprights 10 are attached to a C-shaped base channel 30, which defines the panel foot 11 and includes a top web 31 and opposite side flanges 32. A pair of threaded glides or feet 33 extend through the web 31 of base channel 30 into the bottom ends of outermost uprights 10 to provide vertical adjustability at the opposite sides or ends of base panel 5. The illustrated arms 18 have a square tubular construction substantially identical to that of vertical uprights 10 and include opposite side faces 34, as well as opposite end faces 36. The lower ends 37 of arms 18 are fixedly attached to the side faces 28 of vertical uprights 10 adjacent the upper ends thereof, and extend vertically upwardly therefrom a distance of approximately 2 to 4 inches in vertical alignment with the associated upright 10, thereby defining the yoke-shaped receptacles 19 for drop-in wiring.

In the illustrated example of base panel frame 9, each of the horizontal stringers 12, 13, and 20 has a square tubular construction that is substantially identical with that of vertical uprights 10, and includes opposite faces 40–43 and opposite ends 44. Horizontal stringers 12, 13, and 20 have a length substantially identical with that of base panel 30, and are arranged in a mutually parallel, vertically spaced-apart relationship. In one working example of the present invention, stringers 13 are located approximately 4 inches above floor height, while stringers 12 are located approximately 30 inches above floor height. Horizontal stringers 12 and 13 have their inward faces 41 attached to the outer side faces 28 of vertical uprights 10 by means such as welding or the like. Stringers 20 have their bottom faces 43 rigidly attached to the upper ends 38 of arms 18, and in one working embodiment of the present invention, the same are positioned approximately 40 inches above floor height. Each pair of stringers 12, 13, and 20 is mutually horizontally aligned on opposite sides of its associated vertical uprights 10. The stringers 12, 13, and 20 on the opposite sides of vertical uprights 10 are horizontally coplanar and facilitate the mounting of cover panels 16 and 17 thereon.

With reference to FIGS. 12–15, the illustrated horizontal stringers 12, 13, and 20 are slotted to permit like panels 4 to be interconnected and support various accessories thereon, as described in greater detail hereinafter. With reference to the upper stringers 20, the rear or inward face 41 is full as shown in FIG. 12, while the opposite front face 40 (FIG. 14) includes a series of horizontal slots 50, which extend continuously between opposite ends 44 thereof in a regular pattern. The bottom face 42 of horizontal stringers 12 includes an end slot 51 and a series of windows 52, as shown in FIG. 13, while the opposite top face 43 has an end slot 53 and stacker apertures 54, as shown in FIG. 15. In the base panel frame 9 shown in FIGS. 10 and 11, a pair of clamp brackets 56 are mounted to the opposite ends of each lower stringer 13 and project downwardly therefrom. Each clamp bracket 56 includes a semi-circular notch 57 to receive an associated panel-to-panel clamp 58 (FIGS. 24*b* and 29*a*), as described below.

Figure 5:
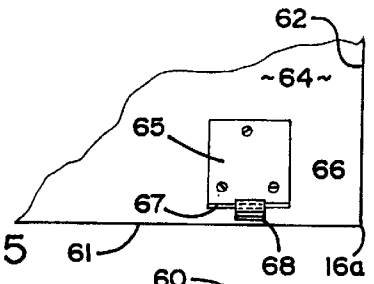
FIG. 5 is a fragmentary, rear elevational view of the cover panel showing a mounting clip thereon.
Figure 6:
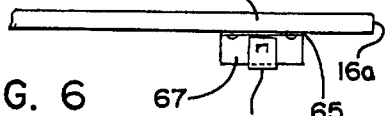
FIG. 6 is a fragmentary, top plan view of the cover panel shown in FIG. 5.
Figure 7:
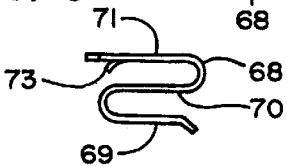
FIG. 7 is a side elevational view of the mounting clip.
Figure 8:
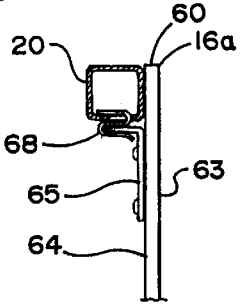
FIG. 8 is a fragmentary, vertical cross-sectional view of a cover panel shown mounted on the base panel frame.
Figure 4:
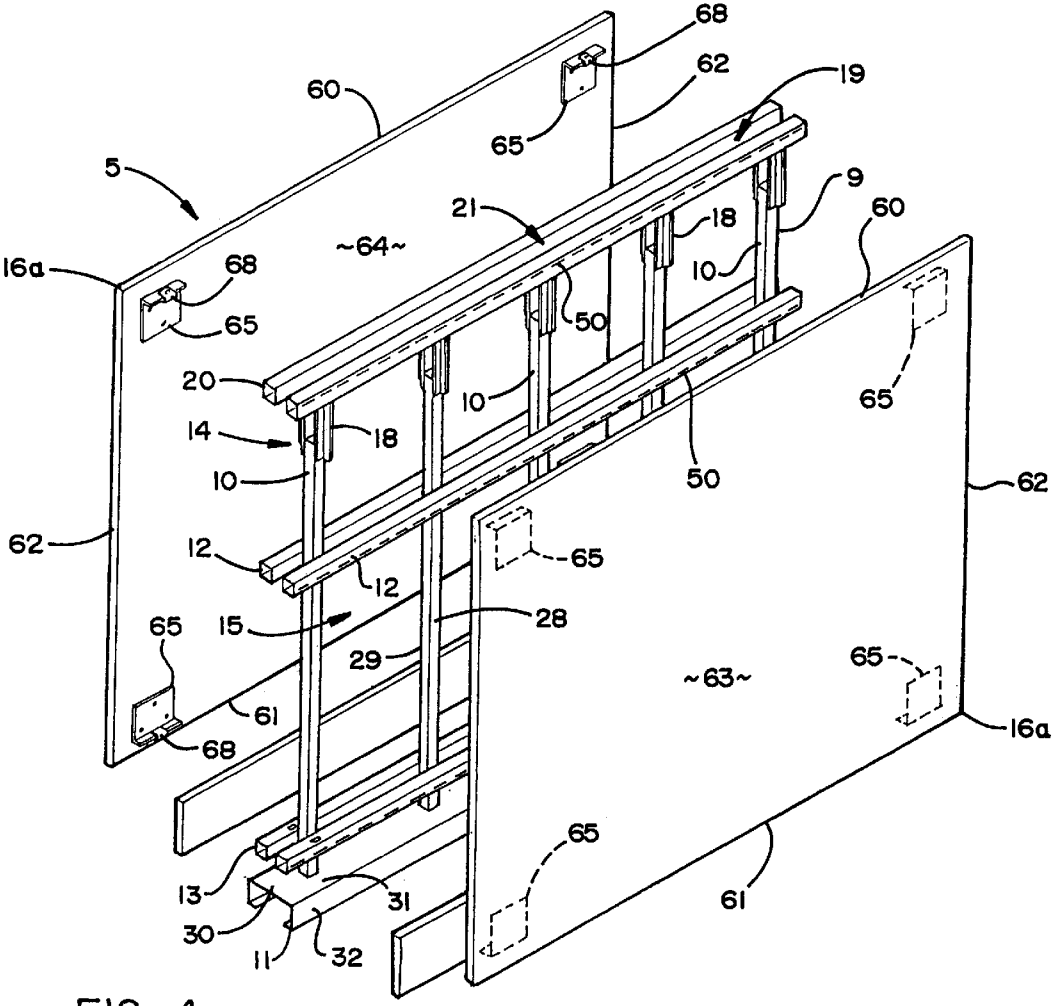
FIG. 4 is an exploded, perspective view of a base panel portion of the partition panel having a frame with removable cover panels.

The illustrated cover panels 16 and 17 (FIGS. 4–8) for base panel 5 have a substantially similar construction, each with a rectangular front elevational shape that includes a top edge 60, bottom edge 61, opposite side edges 62, and opposite faces 63 and 64. The front faces 63 of cover panels 16 and 17 are preferably finished, so as to provide and aesthetically pleasing appearance and may include upholstery, paint, wood veneer, as well as specialty surfaces, such as white board, chalk board, and the like. Each of the cover panels 16 and 17 has a width generally commensurated with that of its associated panel frame 9, and a height generally commensurated with the vertical spacing between an associated pair of horizontal stringers 12, 13, and 20. For example, in the base panel 5 illustrated in FIG. 3, cover panel 16 extends between medial portions of stringers 12 and 13, while cover panel 17 extends between medial portions of stringers 12 and 20. A full height cover 16*a* is shown in FIG. 4, and extends between medial portions of stringers 13 and 20 to enclose the entire face of base panel frame 9. L-shaped brackets 65 are attached to the interior faces 64 of cover panels 16 and 17 adjacent opposite corners thereof by fasteners 66 or another suitable attachment system, such as adhesive, etc. Each of the brackets 65 has an outwardly extending flange 67, which receives a spring-type mounting clip 68 thereon. As shown in FIG. 7, each clip 68 has a generally S-shaped side elevational configuration comprising three parallel leg portions 69–71. The outer leg 69 and center leg 70 form a U-shaped area that snaps onto the flange 67 of brackets 65, as shown in FIGS. 5 and 6. The outer leg 71 includes a barb 73 that engages the window 52 on the associated stringers 12, 13, and 20. Cover panels 16 and 17 are pushed inwardly onto frames 9, so that clips 68 engage brackets 65 to detachably mount the cover panels in the fashion shown in FIG. 8.

In use, the cover panels 16, 17, and 17*a* are installed on an associated base frame 9 in the following fashion. The cover panels 16, 17, and 17*a* are first selected from a group of different widths and heights to match the panel configuration desired. The selected cover panels 16, 17, and 17*a* are then converged onto the opposite sides of the associated frame 19, with clips 68 engaging the aligned stringers 12, 13, and 20. Cover panels 16, 17, and 17*a* are then urged inwardly against the associated panel frame 9, so that the barb 73 on clips 68 engage aligned windows 52 in horizontal stringers 12, 13, and 20 to securely, yet removably, mount the same in place. Cover panels 16, 17, and 17*a* are thereby positioned against or adjacent the outer faces 40 of horizontal stringers 12, 13, and 20, thereby enclosing or completing the horizontal raceway cavities 14 and 15, each of which has a vertically elongated shape when viewed in end elevation. The two horizontal raceway cavities 14 disposed between horizontal stringers 12 and 20 are located adjacent work surface height and define beltway raceway cavities. The two horizontal raceway cavities 15 disposed between horizontal stringers 12 and 13 are located adjacent to the panel base and define lower raceway cavities.

The illustrated stacker panel 6 (FIGS. 3 and 16) has a construction substantially similar to previously described base panel 5, except that it does not have a foot 11 or an intermediate pair of stringers 13. Stacker panel 6 also comes in a variety of different widths, as well as various heights, and mounts directly on top of an associated base panel 5, as discussed in greater detail below.

Figure 16:
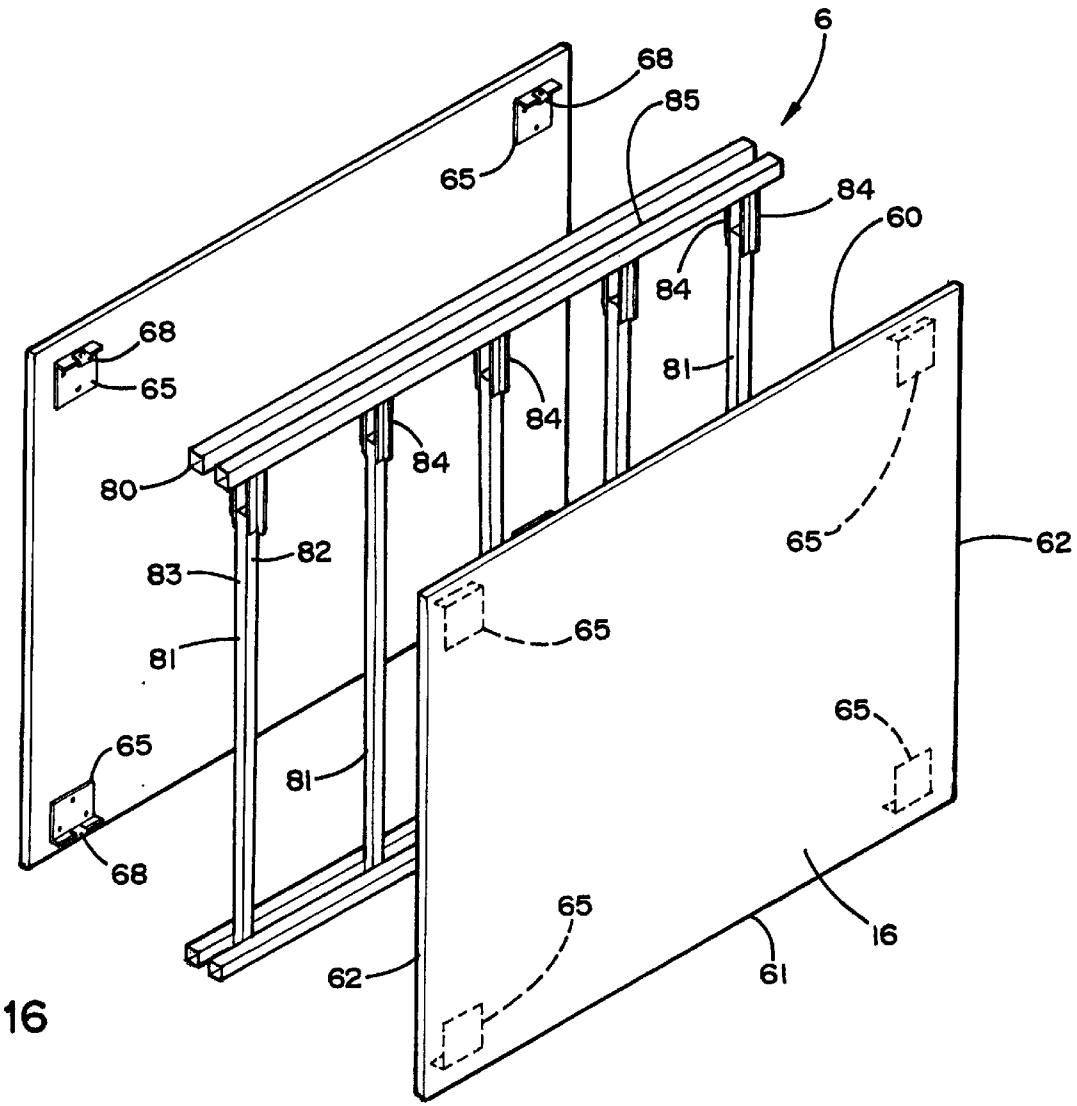
FIG. 16 is an exploded, perspective view of a stacker panel portion of the partition panel having a frame with removable cover panels.
Figures 17, 18, 19, 20, 21, 22, 23:
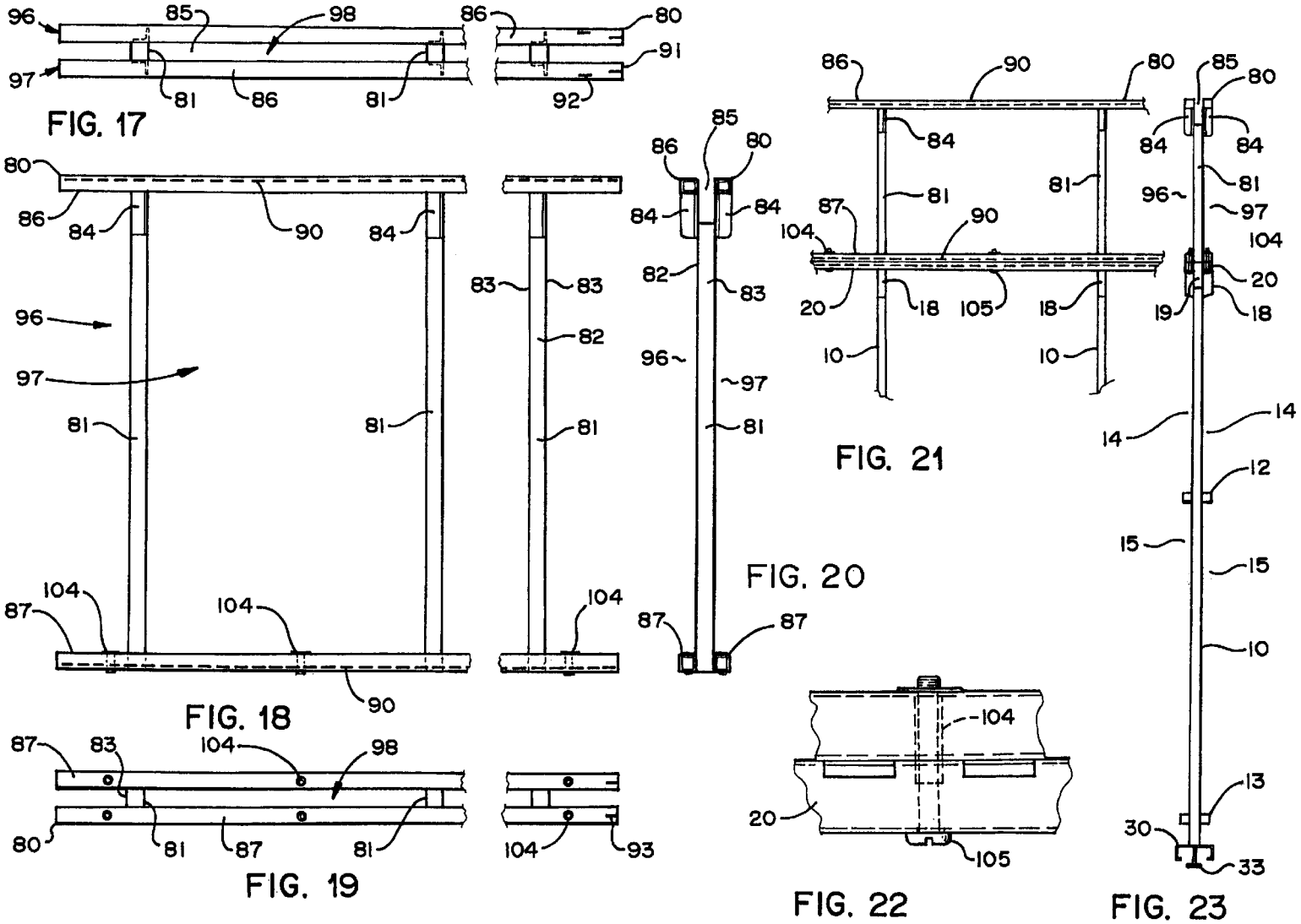
FIG. 17 is a fragmentary, top plan view of the stacker panel frame.
FIG. 18 is a fragmentary, front elevational view of the stacker panel frame.
FIG. 19 is a fragmentary, bottom plan view of the stacker panel frame.
FIG. 20 is a side elevational view of the stacker panel frame.
FIG. 21 is a fragmentary, front elevational view of a stacker panel frame mounted on a base panel frame.
FIG. 22 is an enlarged, fragmentary front elevational view of a connection between the stacker panel frame and base frame shown in FIG. 21.
FIG. 23 is a side elevational view of the interconnected base frame and stacker panel frame shown in FIG. 21.
Figure 32:
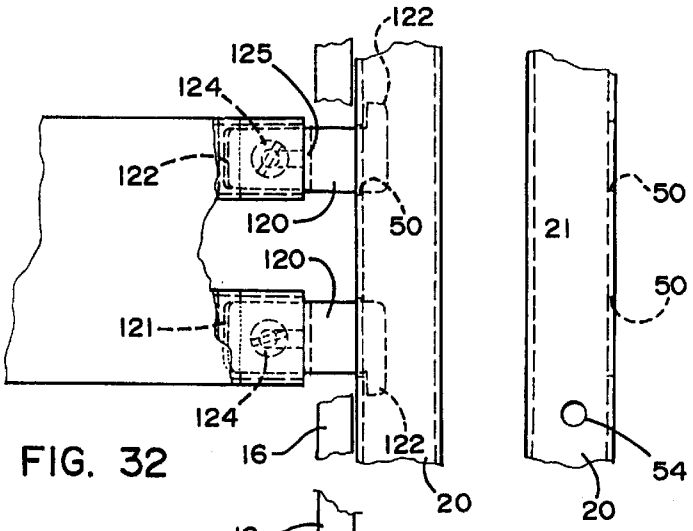
FIG. 32 is a fragmentary, top-plan view of the panels shown in FIGS. 30 and 31, wherein portions thereof have been broken away to reveal internal construction.
Figure 33:
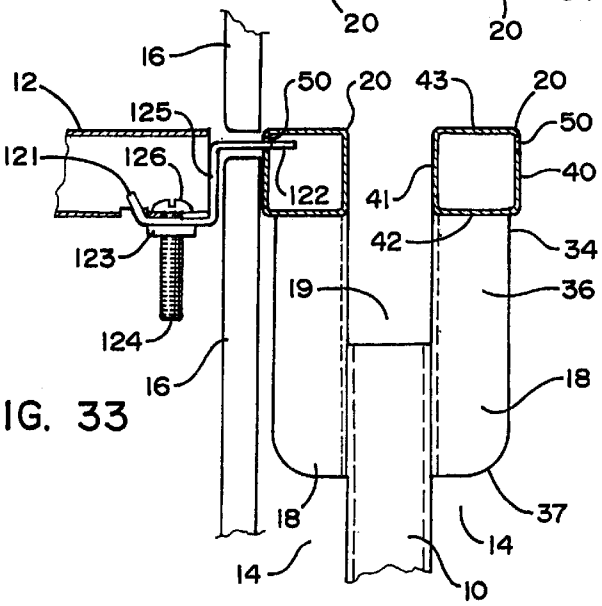
FIG. 33 is a fragmentary, vertical cross-sectional view of the panels shown FIG. 32.
Figure 30:
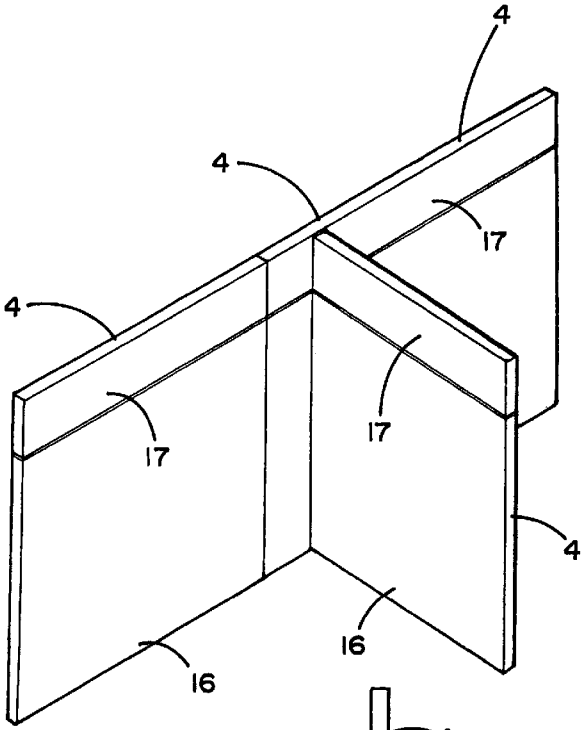
FIG. 30 is a perspective view of three of the partition panels, of which two are interconnected in-line, and one is interconnected at an angle or branched to the in-line panels.
Figure 31:
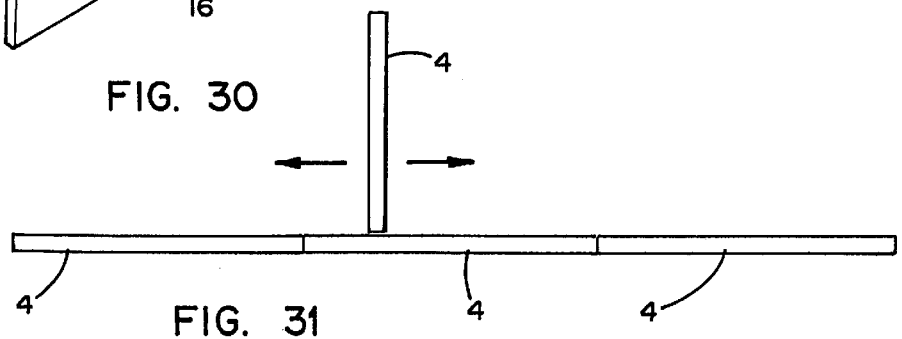
FIG. 31 is a partially schematic, top plan view of the panels shown in FIG. 30, wherein the branched panel can be interconnect anywhere along the in-line panels.

The stacker panel 6 shown in FIG. 16 has a skeleton-like frame 80 comprising five vertical uprights 81, which are spaced generally regularly along the width of stacker panel 6. Each of the vertical uprights 81 is constructed from square tubing, substantially identical to that of base panel uprights 10, and includes opposite pairs of side faces 82 and 83. Arms 84 (FIGS. 17–20), similar to base panel arms 18, are attached to the opposite side faces 82 of each of the stacker panel uprights 81, and extend upwardly from upper ends thereof to define Y-shaped receptacles 85 for drop-in wiring. A first pair of horizontal stringers 86 is attached to the upper ends of arms 84, and a second pair of horizontal stringers 87 is attached to the side faces 82 of uprights 81 adjacent the lower ends thereof. Both pairs of stringers 86 and 87 are constructed from square tubing substantially similar to vertical uprights 81, as well as the stringers 12, 13, and 20 associated with base panel frame 9. Each of the stringers 86 and 87 associated with stacker panel frame 80 has a slotted configuration similar to the stringers 12, 13, and 20 of base panel frame 9, and includes a series of horizontal slots 90 along the forward faces, end slots 91 and windows 92 on the top faces, and end slots 93 on the bottom faces.

The stacker panel 6 illustrated in FIG. 16 has a height substantially equal to the height of the lower panel 16 of the base panel 5 illustrated in FIG. 3, such that cover panel 16 can be mounted directly on the opposite sides of stacker panel frame 80 in the fashion described above with respect to base panel 5. The interior spaces formed between stacker frame uprights 81 and their associated stringers 86 and 87 define horizontal raceway cavities 96 and 97, which open toward the opposite faces of stacker panel 6. Horizontal raceway cavities 96 and 97 are substantially similar to the horizontal raceway cavities 14 and 15 associated with base panel 5, and include open ends which are aligned and communicate with adjacent like stacker panels to route utilities therebetween. Stacker panel 6 also has a vertical raceway cavity 98 (FIG. 17) formed in-between the two horizontal raceway cavities 96 and 97.

As best illustrated in FIGS. 17–23, the lower stringers 87 on stacker panel frame 80 include a plurality of vertically extending threaded sleeves 104 positioned regularly along stringers 87, which facilitate mounting stacker panel 6 on an associated base panel 5. The lower ends of sleeves 104 extend downwardly from the lower surfaces of stringers 87, and form pilots that are closely received and retained in the apertures 54 in the upper surfaces of stringers 12 on base panel 5. Threaded fasteners 105 are inserted upwardly through the apertures 54 in base panel stringers 20, and into the sleeves 104 of stacker panel 6 to securely interconnect the same.

In operation, the height of any given modular panel 4 can be easily varied by selecting the appropriate number and size of base panels 5 and stacker panels 6. In the modular panel 4 illustrated in FIG. 3, a single stacker panel 6 is mounted on top of base panel 5 in the following manner. With all cover panels 16, 17, etc. removed, the selected stacker panel frame 80 is placed on top of the associated base panel frame 9, so that the lower stringers 87 of stacker panel frame 80 rest directly on top of the upper stringers 12 on base panel frame 9. The lower ends of sleeves 104 are inserted into apertures 54 on stringers 12 to squarely orient stacker panel frame 80 on top of base panel frame 9. Fasteners 105 are then inserted through the apertures 54 in the upper stringers 12 of base panel frame 9, and engaged in sleeves 104 to securely connect stacker panel frame 80 on top of base panel frame 9. Cover panels 16, 17, etc. are then positioned over the outer faces of both frames 9 and 80.

With reference to FIGS. 24*a*–29*a*, adjacent modular panels 4 are interconnected in an in-line relationship or side-by-side in the following manner. Panel-to-panel clips 110 are provided, each having a plate-like construction with an upturned tab 111 at one end and a Z-shaped tab 112 at the opposite end. A threaded boss 113 is positioned at a medial portion of the clip 110 and is aligned with a mating aperture in which a threaded fastener 114 is received. In the in-line example illustrated in FIGS. 24*a*–29*a*, when like base panel frames 9 are positioned end-to-end, the associated stringers 12, 13, and 20 are aligned with the opposite ends abutting one another. Any stacker panel frames 80 are similarly positioned end-to-end and aligned. With reference to the illustrated base panel 5, the panel-to-panel clips 110 are used to interconnect the opposite ends of each adjacent pair of horizontal stringers 12 and 20 in the following manner. As shown in FIG. 27, the Z-shaped tab 112 of clip 110 is first inserted into the lower window 55 in one of the adjacent stringers, such as the illustrated stringers 12. The head portion 115 of fastener 114 is positioned between the top and bottom faces 42 and 43 of the adjacent stringers 12. The upturned tab 111 of clip 110 is then inserted into the lower window 55 of the opposite stringer 12, and fastener 114 is then tightened, which may be accomplished by inserting a tool (not shown) through the windows 51 in the top faces 42 of stringers 12. After all fasteners 114 have been tightened, the opposite tabs 111 and 112 on clips 110 positively interconnect the opposite ends of the associated stringers 12. When a pair of base panels 5 are positioned in-line, preferably the ends of each of stringers 12 and 20 are thusly interconnected, thereby requiring four clips 110.

In the example shown in FIG. 24*b*, a panel-to-panel clamp 58 is used to interconnect the adjacent ends of the lower stringers 13. As best shown in FIG. 29*a*, panel-to-panel clamp 58 includes a pair of U-shaped bracket halves 117, each having a pair of apertures 118 through which fasteners 119 are received. As shown in FIG. 24*b*, the two clamp halves 117 are positioned on opposite sides of brackets 56, with fasteners 119 passing through notches 57. When fasteners 119 are tightened the opposite halves 117 of bracket 58 capture the four adjacent brackets 56 therein to securely interconnect the lower stringers 13 end-to-end.

With reference to FIGS. 30–33, modular panels 4 can also be interconnected in a branched or angular configuration in the following fashion. Branching clips 120 are provided and have a generally plate-shaped construction, which includes an upturned tab 121 at one end and a horizontally oriented hook 122 at the opposite end. A threaded boss 123 is mounted on a lower portion of branching clip 120 and is aligned with a mating aperture in which a threaded fastener 124 is received. Branching clip 120 has an L-shaped center portion 125, which extends along the end 44 of an associated one of the stringers, such as the illustrated stringers 12.

In use, the modular panel 4 can be interconnected to a like modular panel 4 in an angular orientation at locations anywhere along the length of the in-line panels. For instance, in the example illustrated in FIGS. 30 and 31, three panels 4 are shown interconnected in an in-line orientation in the fashion described herein above. A single panel 4 is shown attached at a 90 degree angle to the three in-line panels at a position intermediate the opposite side edges of the center panel 4. It is to be understood that the branched panel 4 can be attached anywhere along the length of the three in-line panels, which greatly facilitates space planning.

A branched panel 4 is mounted in the following manner. A pair of branching clips 120 are selected and hook ends 122 are inserted into the adjacent slots 50 in stringers 12, 13, and 20 at the location at which the branched panel 4 is to be located. The heads 126 of fasteners 124 are positioned in the hollow interiors of stringers 12. The tab ends 121 of clips 120 are shifted into the lower windows 55 in stringers 12, and fasteners 124 are then tighten to securely interconnect the branched panel 4.

ADDITIONAL EMBODIMENTS

Figure 46:
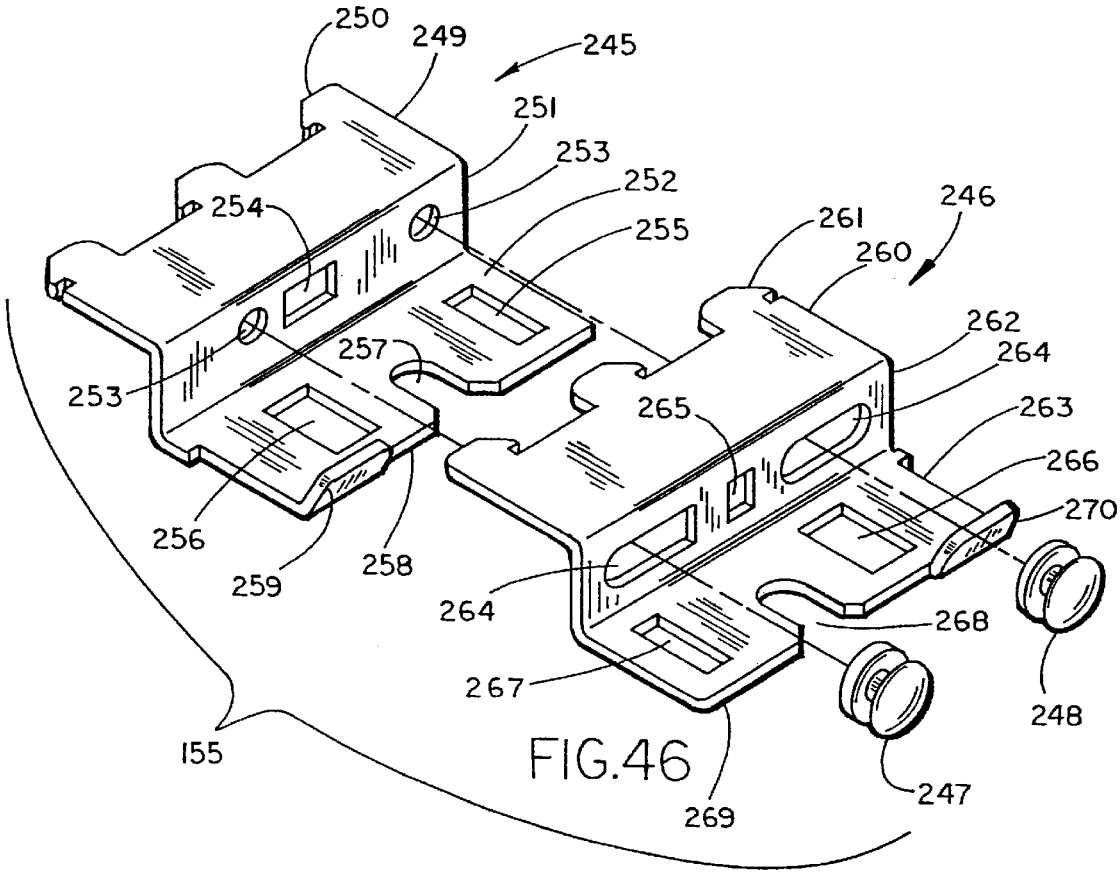
FIG. 46 is an exploded perspective view of an off-module connector for interconnecting base partition panels in a T-shaped arrangement.
Figure 53:
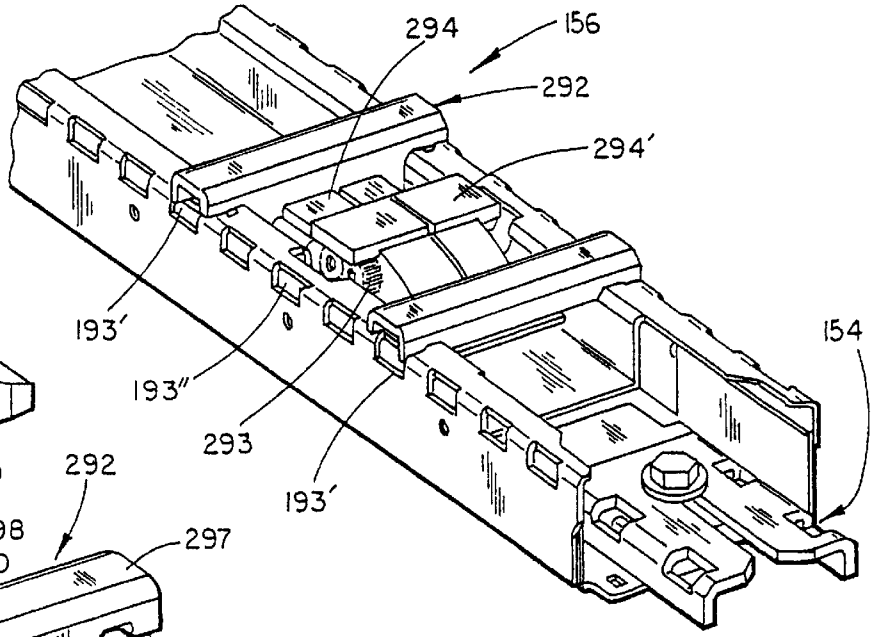
FIG. 53 is a perspective view comparable to FIG. 52, but with the stacking connector engaging the top frame member of the base partition panel.
Figure 52:
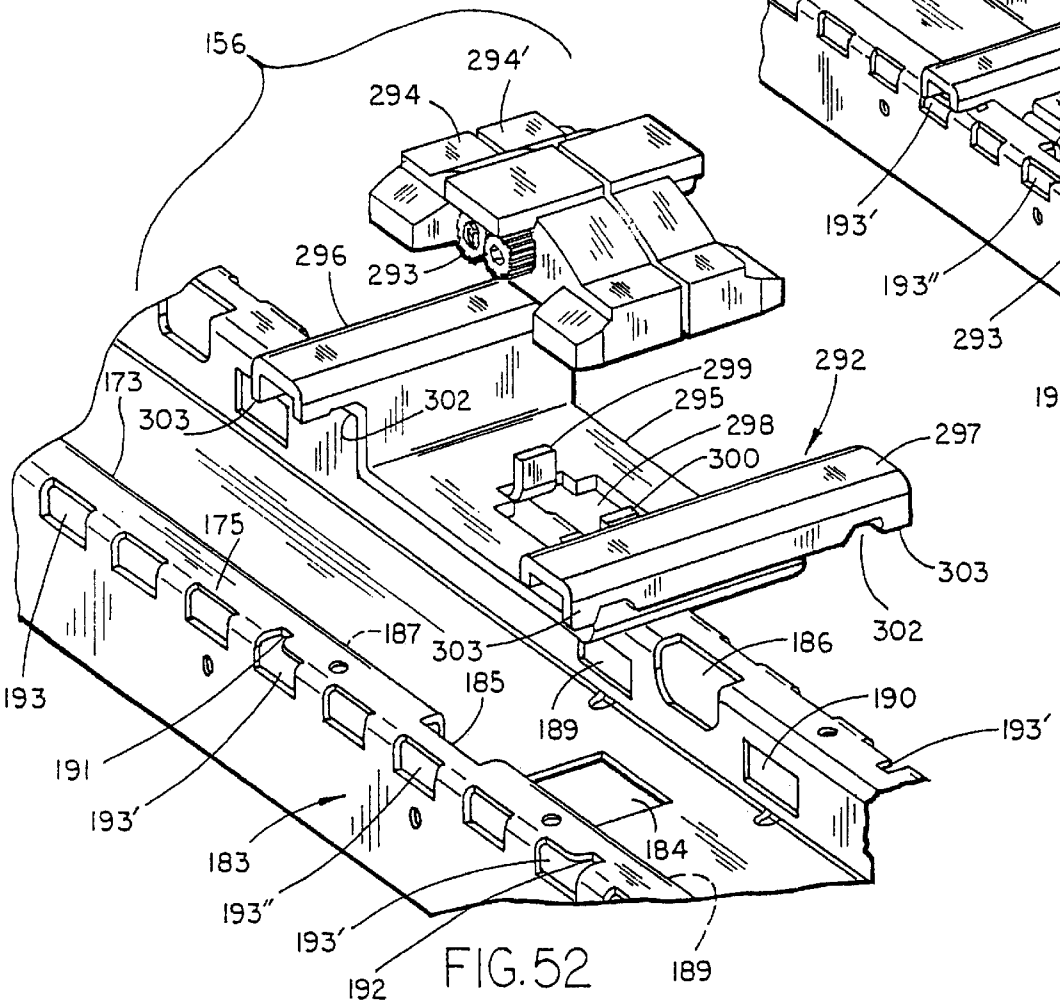
FIG. 52 is an exploded perspective view of the stacking connector engaging the top frame member of a base partition panel, the stacking panel being removed to more clearly show the engagement of the stacking connector to the top frame member of the base partition panel.

A wall construction 150 (FIG. 34) includes a plurality of lower/base partition panels 151 and upper/stacking partition panels 152 interconnectable in an infinite number of different in-line, stacked, and off-module arrangements, including combinations thereof. More specifically, the panels 151 and 152 are interconnectable frame-to-frame with a connection system including mating in-line connectors 153 and 154 (FIGS. 39–41), off-module connectors 155 (FIGS. 46–48), and stacking connectors 156 (FIGS. 52 and 53). The panels 151 and 152 are reconfigurable to meet constantly changing office needs, including the ability to construct walls with "T" intersections located intermediate the vertical side edges of panels, and the ability to construct walls having different heights and/or non-uniform heights. (For example, compare FIGS. 34 and 71–75.)

Base partition panel 151 (FIGS. 35 and 36) includes a base panel space frame 160 having a substantially rectangular side elevational configuration. The space frame 160 includes three vertically oriented structural tubes 161–163 which are interconnected in a laterally spaced-apart relationship by four horizontally oriented structural tubes 164–167 and also by a pair of intermediate side frame members 168 and 169. Notably, more or less vertical and horizontal structural tubes can be used if desired. In the illustrated example, center vertical tube 162 and horizontal tubes 164–167 have a square cross section, while end vertical tubes 161 and 163 have a rectangular cross section, the elongated dimension of the rectangle being oriented in a parallel plane defined by the vertical tubes of the base partition panel 151. Also, the intermediate side frame members 168 and 169 have a C-shaped cross section, with the legs of the C-shape facing inwardly and engaging the sides of the vertical tubes 161–163 and frame members 168 and 169. The tubes 161–167 and side frame members 168 and 169 are welded together to provide a rigid space frame 160 for receiving and interconnecting with other space frames as discussed below. The vertical tubes 161–163 extend substantially from the top to the bottom of base space frame 160, and the horizontal tubes and side frame members 164–169 extend substantially the width of space frame 160 and align with frame members in adjacently positioned panels.

Figure 68:
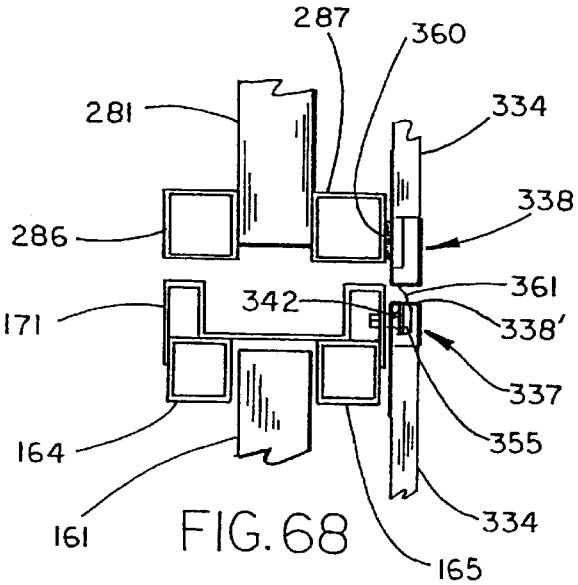
FIG. 68 is an enlarged view of the cover-to-panel connection at the top frame member of the base panel.
Figure 69:
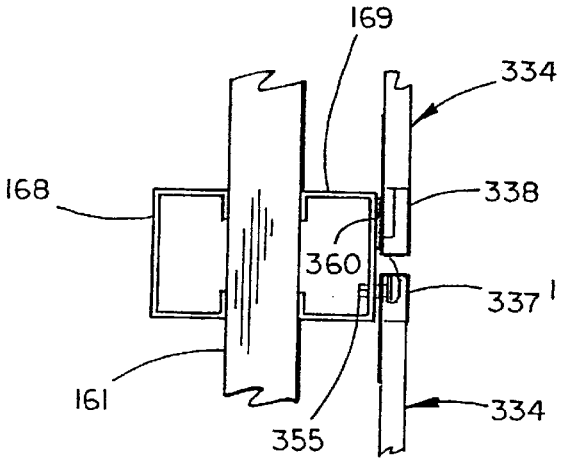
FIG. 69 is an enlarged view of the cover-to-panel connection at the intermediate rail of the base panel.
Figure 70:
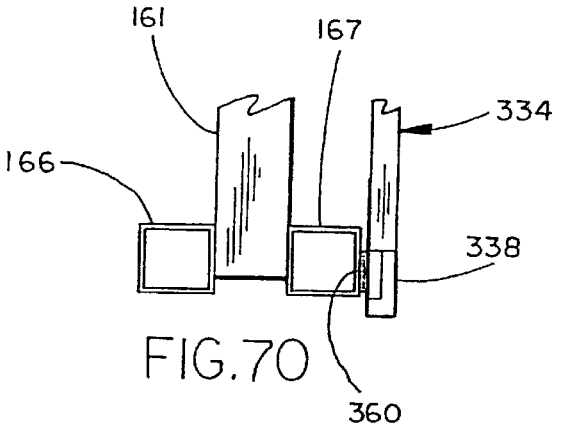
FIG. 70 is an enlarged view of the cover-to-panel connection at the bottom frame member of the base panel.

A top frame member 171 (FIG. 35) is welded to the top of space frame 160. Top frame member 171 (FIGS. 37 and 38) has a W-shaped cross section, including a U-shaped center frame section comprising center flange 172 and vertical side flanges 173 and 174. A pair of inverted L-shaped side sections extends from side flanges 173 and 174, respectively, including top flanges 175 and 176 and outermost side flanges 177 and 178, respectively. The top frame member 171 is welded to top horizontal tubes 164 and 165 (see FIG. 68) to form a rigid matrix. A row of apertures 179 (FIG. 39) is formed at the juncture of flanges 175 and 177 and at the juncture of flanges 176 and 178. The apertures 179 extend partially onto side flanges 177 and 178 so that they are accessible horizontally from a location beside the partition panel. As described hereinafter, the apertures 179 are accessible through a gap between covers attached to the space frames for receiving off-module connectors 155, and also for receiving an Allan wrench to operate the actuator 293 of stacking connectors 156.

A pattern 183 of second apertures is also formed at intervals of about every few inches along the top frame member 171, such as every 12 inches. Aperture pattern 183 includes a horizontal slot 184 formed in center flange 172, a front-side middle aperture 185 formed at the juncture of flanges 173 and 175, and an opposing rear-side middle aperture 186 is formed at the juncture of flanges 174 and 176. Longitudinally adjacent right and left apertures 187 and 188 are formed in flange 173 on both sides of middle aperture 185, and longitudinally adjacent right and left apertures 189 and 190 are formed in flange 174 on both sides of middle apertures 186. Pattern 183 further includes notches 191 and 192 formed in selected ones of the apertures 179, the selected ones being the apertures 179' spaced two apertures from the apertures 179" centered in aperture pattern 183 (FIG. 52). The notches 191 and 192 are located in top flanges 175 and 176, respectively, at the corners of the apertures 179' located farthest apart. The center flange 172 and side flanges 173 and 174 are cutaway at the opposing ends 172' and 172" (FIG. 37) of top frame member 171 to provide room for in-line connectors 153 and 154.

In-line connector 153 (FIG. 39) includes a W-shaped reinforcement bracket or platform 195 having a center flange 196, vertical intermediate flanges 197 and 198 extending from center flange 196, horizontal flanges 199 and 200 extending from intermediate flanges 197 and 198, and upright vertical side flanges 201 and 202 extending from horizontal flanges 199 and 200. Upright flanges 201 and 202 are spaced apart to fit mateably between and against outermost side flanges 177 and 178 at the end of top frame member 171 so that they can be welded to frame member 171. A stiffening flange 203 is formed on the outer end of bracket 195 on center flange 196. A cinch-plate receiving aperture 204 is formed at the juncture of center flange 196 and vertical intermediate flange 197 at a location spaced from stiffening flange 203, and a second cinch-plate receiving aperture 205 is formed at the juncture of center flange 196 and vertical intermediate flange 198 at a second location spaced from stiffening flange 203. A U-shaped bracket 206 is welded to the underside of center flange 196. The bracket 206 includes spaced-apart first and second legs 207 and 208 attached to center flange 196 on opposing longitudinal sides of apertures 204 and 205. A cinch plate 210 is located within bracket 206. Cinch plate 210 includes a body 211 including a threaded hole 211', and opposing wings 212 that extend at an angle outwardly from body 211. The wings 212 are spaced apart and configured to extend through the cinch-plate receiving apertures 204 and 205. A screw 214 is configured to extend through a hole 215 in center flange 196 and threadably into cinch plate 210. Bracket 206 retains cinch plate 210 on bracket 195 and maintains the alignment of the cinch plate 210 with apertures 204 and 205 as screw 214 is turned. By rotating screw 214, cinch plate 210 is drawn against center flange 196, thereby causing wings 213 to extend through apertures 204 and 205. Slots 217 and 218 are formed in the ends of horizontal flanges 199 and 200, respectively, for receiving a trim piece, a trim piece retainer or the like.

In-ine connector 154 includes a telescopeably movable bracket 220 (FIG. 40). Telescopeable bracket 220 is elongated and U-shaped, and includes a center flange 221 and side flanges 222 and 223 which are configured to mateably rest on and straddle center flange 196 of connector bracket 195 (FIG. 41). Two cinch-plate receiving apertures 224 and 225 (FIG. 40) are formed along the juncture of flanges 221 and 222, and also two cinch-plate receiving apertures 226 and 227 are formed along the juncture of flanges 221 and 223. A slot 228 extends from an end 229 of bracket 220, and extends past apertures 224–227. As shown in FIG. 41, bracket 220 is configured to mateably slidably rest on center flange 196 of reinforcement bracket 195 of off-module connectors 155 in an extended position, with the apertures 225 and 227 aligned with apertures 204 and 205. Alternatively, telescopeable bracket 220 is movable to a retracted position wherein apertures 224 and 226 are aligned with apertures 204 and 205 on reinforcement bracket 195. In the extended position, the apertures 224 and 226 are extended to a position alignable with cinch-plate receiving apertures 204 and 205 on an adjacent and aligned base panel 151 so that the adjacent base panels can be rigidly interconnected in an in-line, frame-to-frame arrangement. Notably, it is contemplated that termination elements for connecting a base panel 151 to an architectural wall or the like and for filling the space therebetween will be constructed with one end having a laterally extending bracket simulating extendable bracket 220 for connection to an end of the base panel 151, and having a second end configured for connection to the architectural wall. The laterally extending bracket can be fixed, removed (e.g., bolted), or extended, and the termination element can include conventional telescoping or field-cuttable elements.

Figure 42:
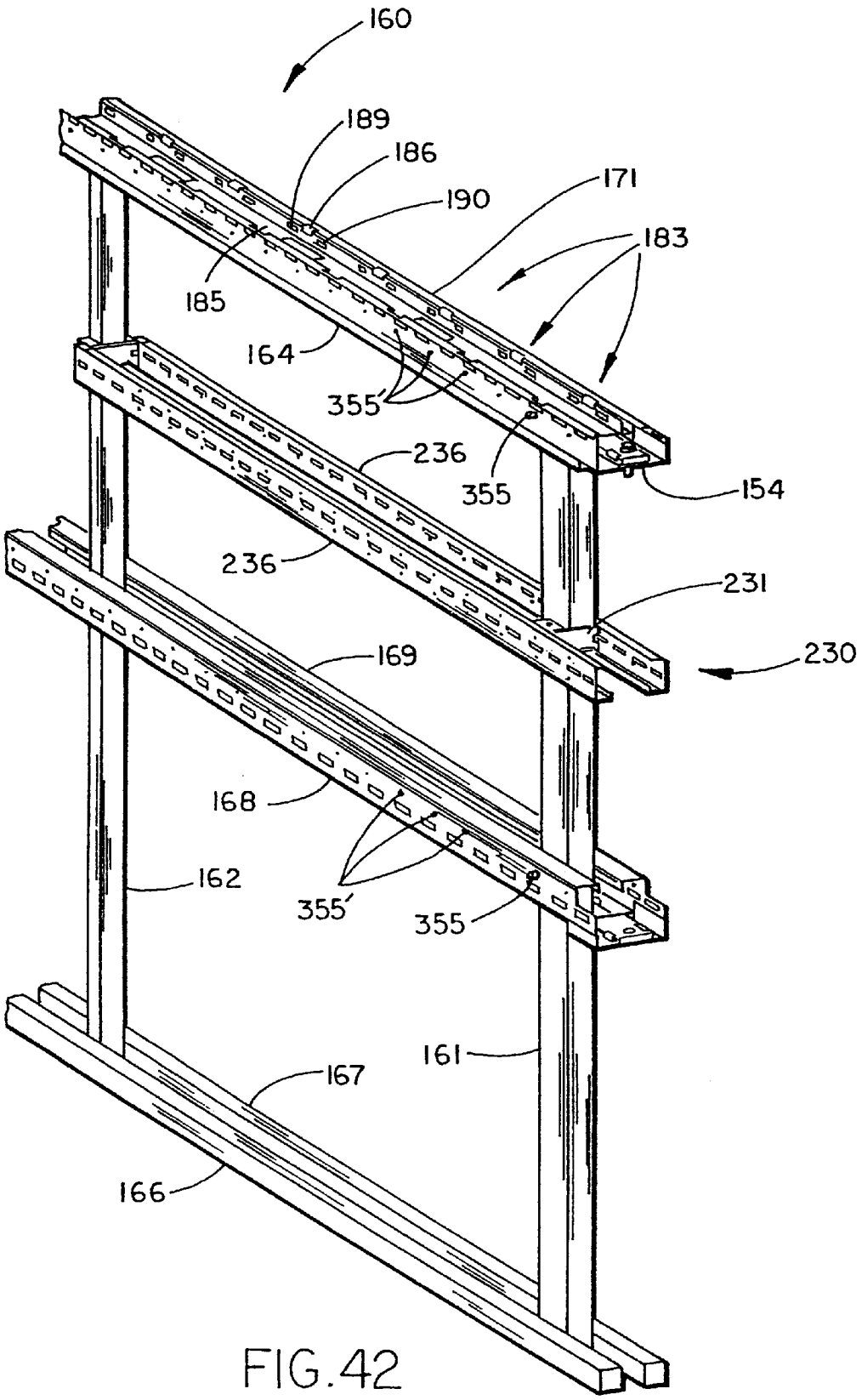
FIG. 42 is an enlarged, fragmentary perspective view of the space frame of the base partition panel shown in FIG. 36, including an optional cover support frame member.
Figure 45:
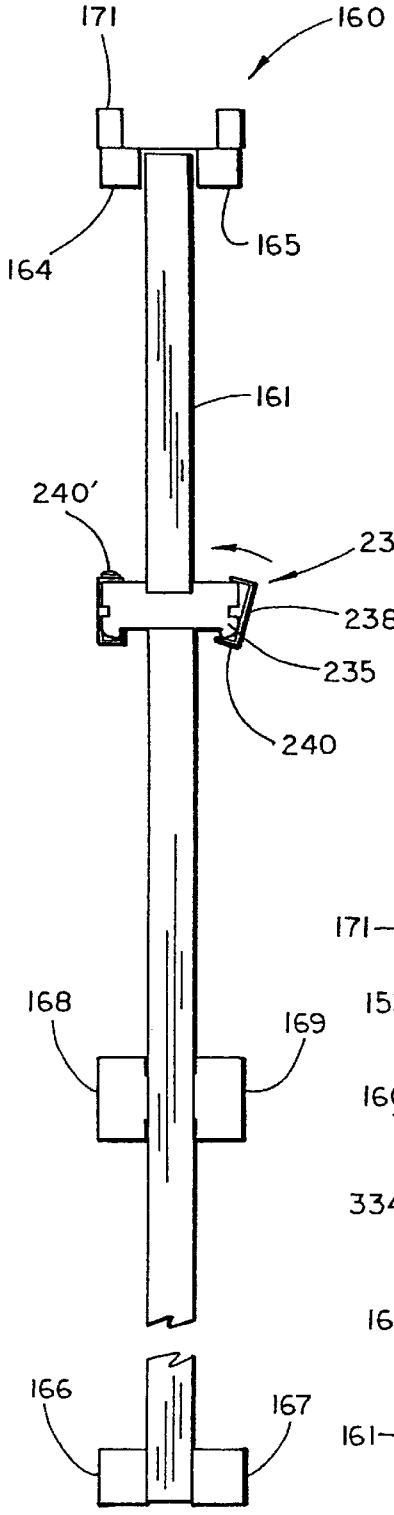
FIG. 45 is a fragmentary end elevational view of the base panel shown in FIG. 42.
Figure 43:
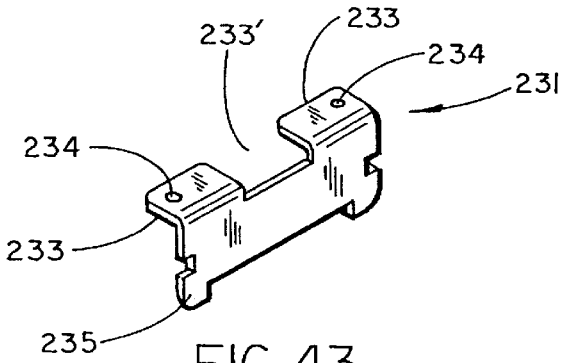
FIG. 43 is a perspective view of a bracket for securing the optional cover support frame member to the base panel shown in FIG. 42.
Figure 49:
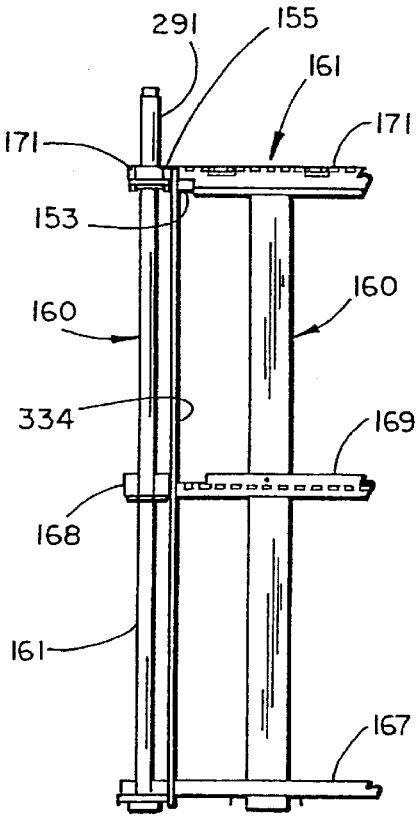
FIG. 49 is an end elevational view of the T-shaped arrangement of base panels shown in FIG. 48.
Figure 44:
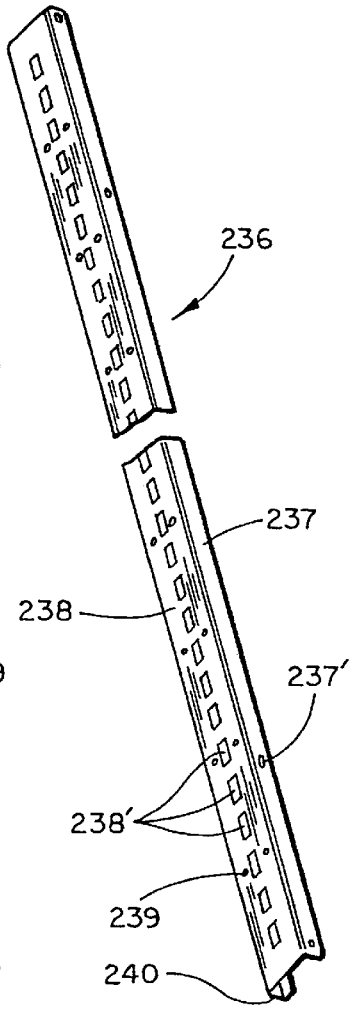
FIG. 44 is a fragmentary perspective view of the optional cover support frame member shown in FIG. 42.

As discussed below, covers are attached to the sides of base space frame 160. In some situations, it may be desirable to support the covers with an intermediate brace 230 (FIG. 42). This also allows the covers to be halved in size, such that one cover can be supported between the top frame member 171 and the intermediate brace 230, and a second cover between the intermediate brace 230 and the intermediate side frame members 168 and 169. The intermediate brace 230 includes a sheet metal bracket 231 welded to vertical structural tubes 161 (and 162 and 163) at a predetermined height. Bracket 231 (FIG. 43) includes an L-shaped body having a vertical flange 232 and horizontally disposed top flanges 233. The top flanges 233 define a notch 233' therebetween for mateably engaging the vertical structural tubes 161 (or tubes 162 and 163). The top flanges 233 include holes 234. The lower edge of vertical flange 232 includes teeth 235. Intermediate brace 230 also includes a structural beam 236 (FIG. 44) that is generally C-shaped. Brace 236 includes a top flange 237 having holes 237', a vertical flange 238 having a row of apertures 238' and paired holes 239 periodically spaced across its length, and a lower flange 240 defining a space configured to mateably receive teeth 235 on bracket 231. Structural beam 236 is attached to bracket 231 by positioning teeth 235 in the space defined by lower flange 240 (FIG. 45), and by tipping beam 236 onto bracket 231 so that holes 237' in brace 236 align with holes 234 in bracket 231. Screws 240' are extended through the aligned holes 234 and 237' to secure the beam 236 to base space frame 160. It is noted that the apertures 238' are generally identical to apertures 179 of top frame member 171 in shape and function.

The off-module connectors 155 (FIG. 46) include a pair of configured plates 245 and 246 slidably interconnected by a pair of rivets or headed bolts 247 and 248. Lower plate 245 is generally Z-shaped and includes an upper flange 249 having hooks 250, a middle flange 251 that extends generally perpendicular to upper flange 249, and a lower flange 252 the extends from middle flange 251 parallel upper flange 249. A pair of holes 253 are formed in middle flange 251, along with a window 254 located between the holes 253. A pair of apertures 255 and 256 is formed in lower flange 252. A slot 257 extends from the free edge 258 of lower flange 252 between apertures 255 and 256. An angled tab 259 extends from free edge 258 along a side edge of lower flange 252. Upper plate 246 is also generally Z-shaped so that it matingly slidingly engages lower plate 245. Upper plate 246 includes an upper flange 260 having hooks 261, a middle flange 262 that extends generally perpendicular to upper flange 260, and a lower flange 263 the extends from middle flange 262 parallel upper flange 260. Hooks 261 face in a direction opposite to hooks 250. A pair of aligned slots 264 are formed in middle flange 262, along with a window 265 located between the holes 264. Rivets 247 and 248 extend loosely through holes 253 and slots 264, so that upper plate 246 can slide on lower plate 245 with rivets 247 and 248 sliding within slots 264 on middle flange 262 of upper plate 246. A pair of apertures 266 and 267 is formed in lower flange 263. A slot 268 extends from the free edge 269 of lower flange 263 between apertures 266 and 267. An angled tab 270 extends from free edge 269 along a side edge of lower flange 263.

Figure 47:
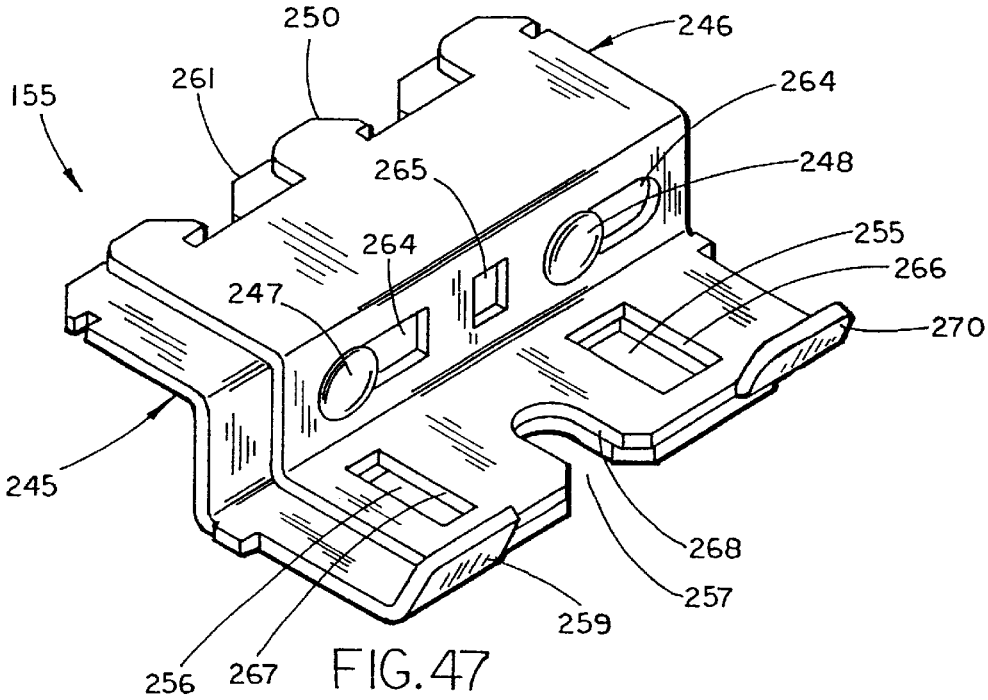
FIG. 47 is a perspective view of the off-module connector shown in FIG. 46.

Plates 245 and 246 (FIG. 47, shown in the expanded position) are movable to a collapsed first position where hooks 250 and 261 are positioned to form a minimum dimension so that the hooks can be slid into selected ones of apertures 179 in top frame member 171. The plates 245 and 246 are also movable to an expanded second position (shown in FIG. 47) where the hooks 250 and 261 are spread apart to securely engage the apertures 179 (see FIG. 48). A detent or friction-generating spring can be added to hold the plates 245 and 246 in the selected position to facilitate assembly of a wall construction if desired. When in the second position, the apertures 255 and 266, and also the apertures 256 and 267, are aligned so that they can be engaged by the wings 212 on cinch plate 210 of an in-line connector 153 (see FIG. 39). Also, the angled tabs 259 and 270 (FIG. 47) are adapted to engage the recesses defined beside the center flange 172 of top frame member 171 to limit the expanding/collapsing movement of plates 245 and 246 and to help center off-module bracket 154 on an off-module connected panel. Thus, the off-module connectors 155 are adapted to be installed and secured selectively along the base space frame 160. Once installed, a base panel 151 can be positioned in an off-module arrangement (see FIGS. 48 and 76) so that an in-line connector 153 on the base panel can be attached to the off-module connectors 155 with its cinch plate 210 engaging apertures 255 and 266, and 256 and 267. The off-module connectors 155 connect the frame of the off-module space frame 160 directly to the base panel 151, such that the interconnection is particularly rigid. The interconnection is rigid because the screw 214 is slid into the slots 257 and 268 in the same manner that screw 214 is slid into slot 228 of bracket 220 (FIG. 41), thereby securing the wings 212 within the apertures 255, 266, 256, and 267. The plates 245 and 246 are further secured in the interconnection because the plates 245 and 246 are clamped together between the screw 214 and the center flange 196.

Figure 35:
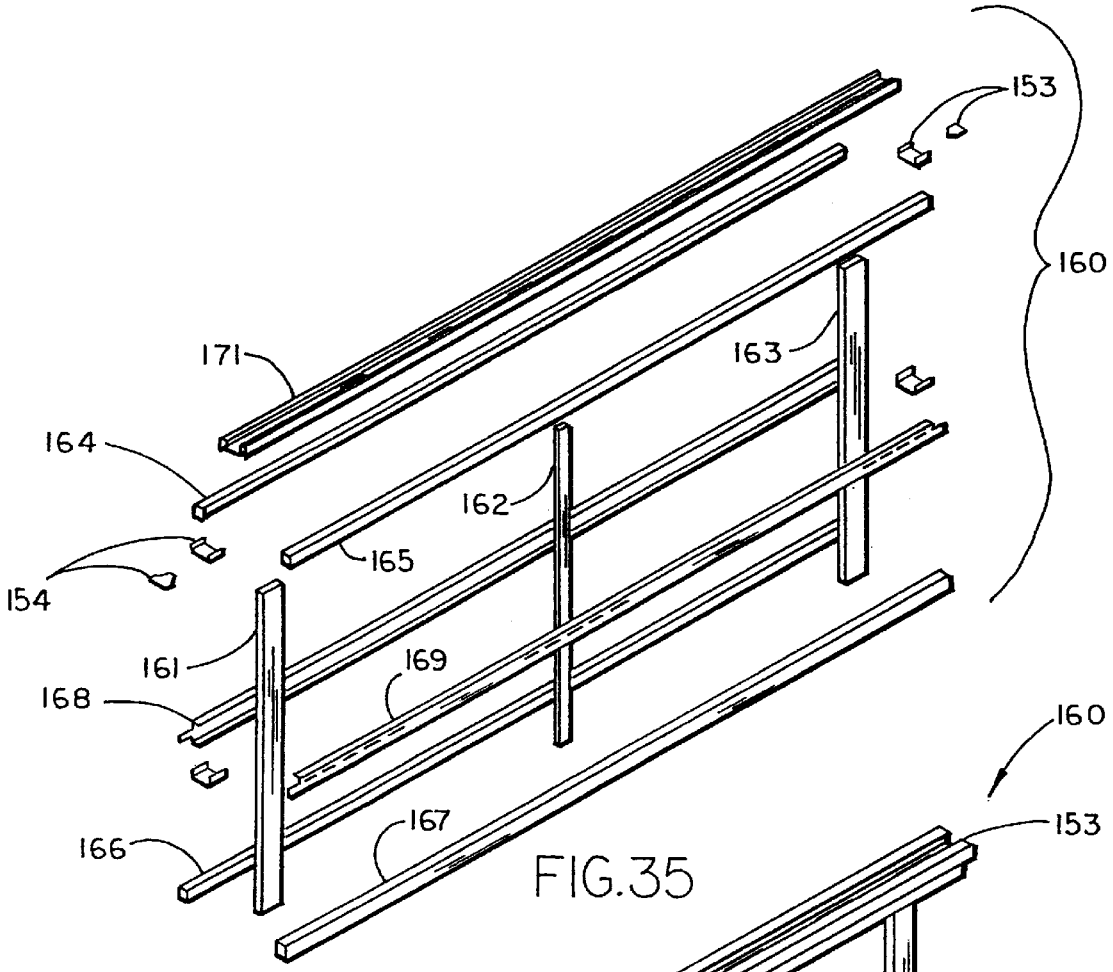
FIG. 35 is an exploded perspective view of a space frame of a base partition panel embodying the present invention.
Figure 36:
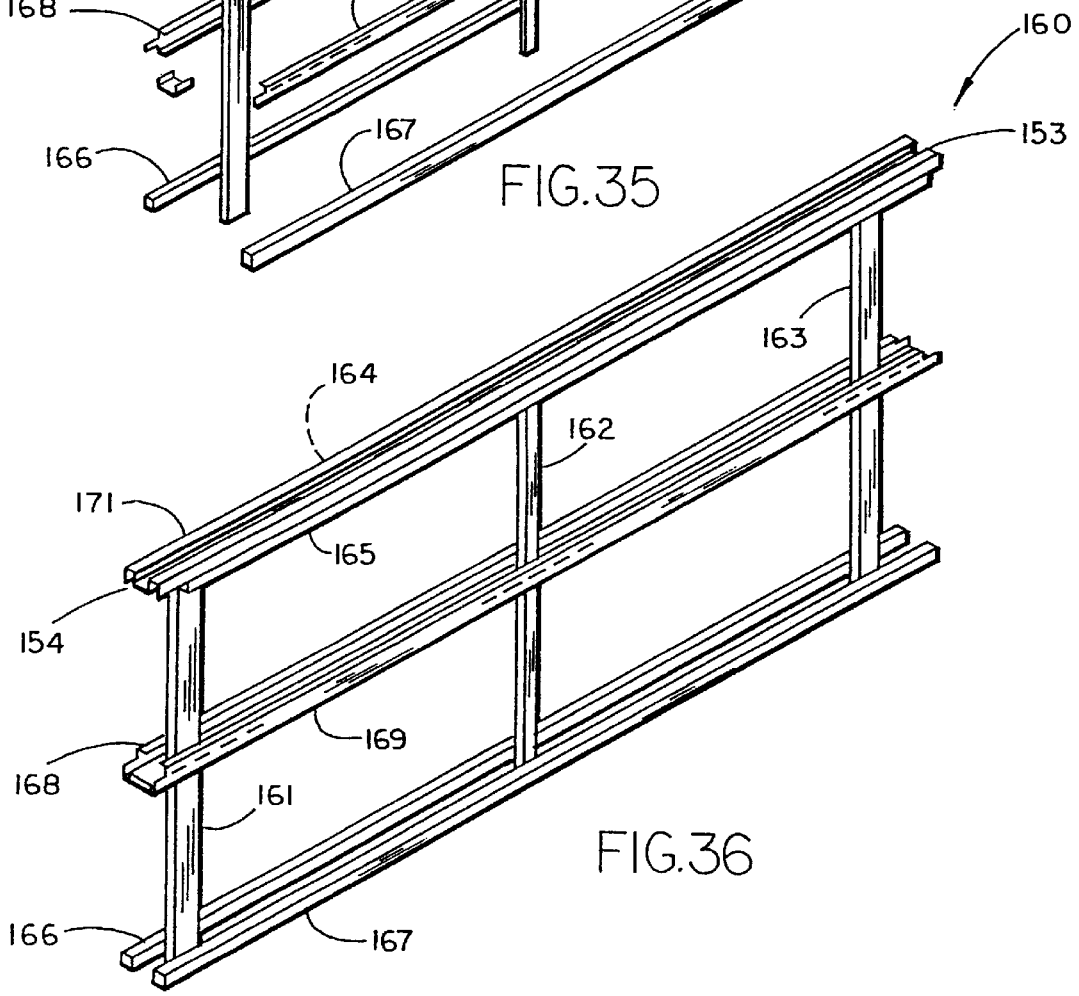
FIG. 36 is a perspective view of the space frame shown in FIG. 35.
Figures 50, 51:
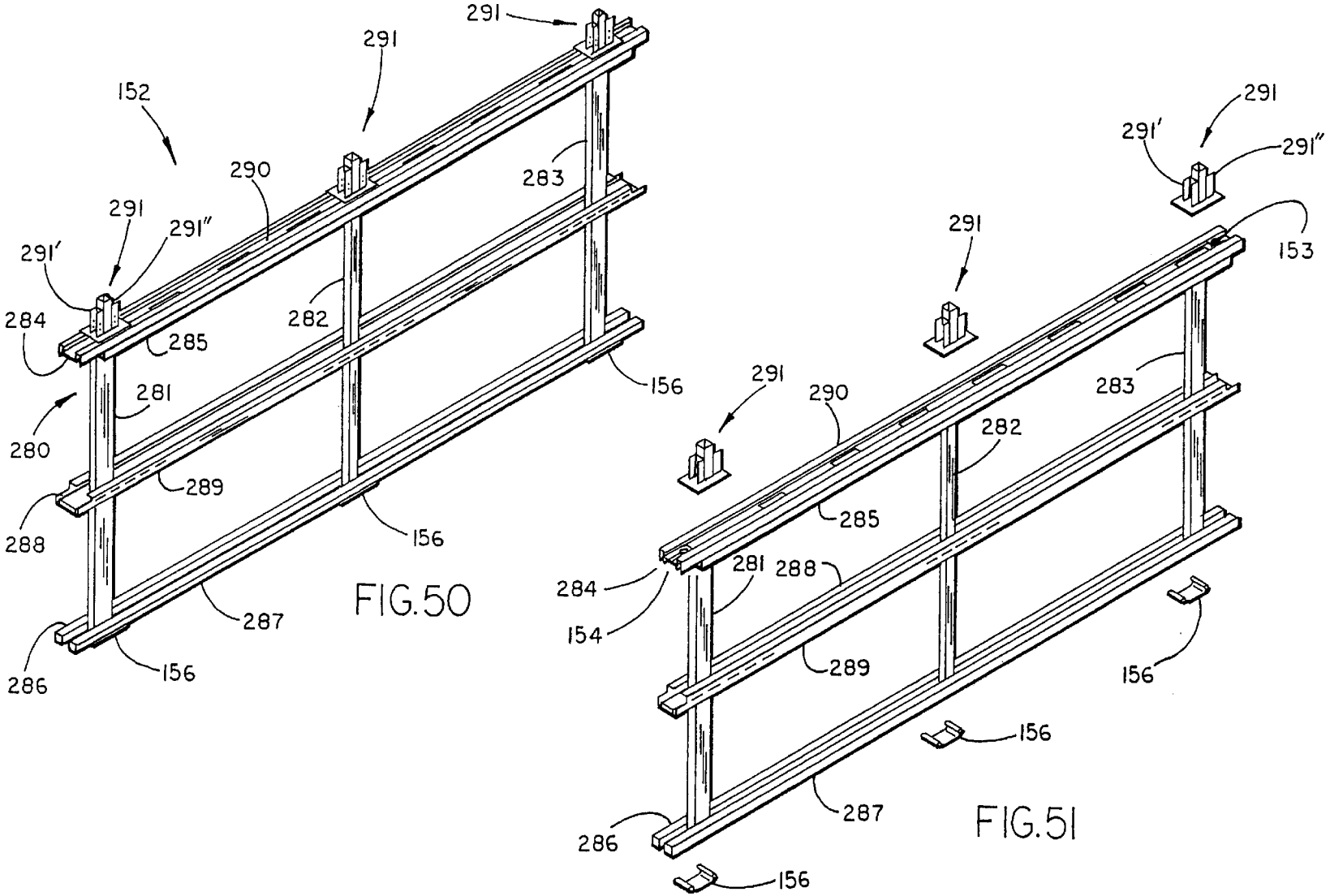
FIG. 50 is a perspective view of a space frame of the stacking partition panel shown in FIG. 34.
FIG. 51 is a partially exploded view of the stacking partition panel shown in FIG. 50.

Stacking panel 152 (FIGS. 50 and 51) includes a space frame 280 substantially structurally identical to base space frame 160 except as noted below. In particular, the stacking space frame 280 includes a plurality of vertically oriented structural tubes 281–283 which are interconnected in a laterally spaced-apart relationship by a plurality of horizontally oriented structural tubes 284–287 and also by a pair of intermediate side frame members 288 and 289. The vertical tubes 281–283 extend substantially from the top to the bottom of space frame 280, and the horizontal tubes and side frame members 284–289 extend substantially the length of space frame 280. A top frame member 290 is attached horizontally to the top of stacking space frame 280, the top frame member 290 being similar to base top frame member 171. A plurality of upright transom-supporting brackets 291 is optionally attached to the top of stacking panel 290 to support a transom thereon. Transom-supporting bracket 291 comprises a lower panel 291' welded or bolted to top frame member 290, and a pair of oppositely facing C-shaped channels 291" configured to receive and retain elongated transom panels, such as windows or opaque sound absorbing panels not unlike covers 334. A plurality of spaced-apart stacking connectors 156 are attached to the bottom of stacking panel 152 at spaced-apart positions corresponding to the spacing of aperture patterns 183 on top frame member 171 (FIGS. 35–37). This allows the stacking partition panel 152 to be selectively positioned on top frame member 171 in any of a variety of different/longitudinally spaced positions, several of which are staggered, as described below. (For example, see FIGS. 74 and 76.)

Figure 53A:
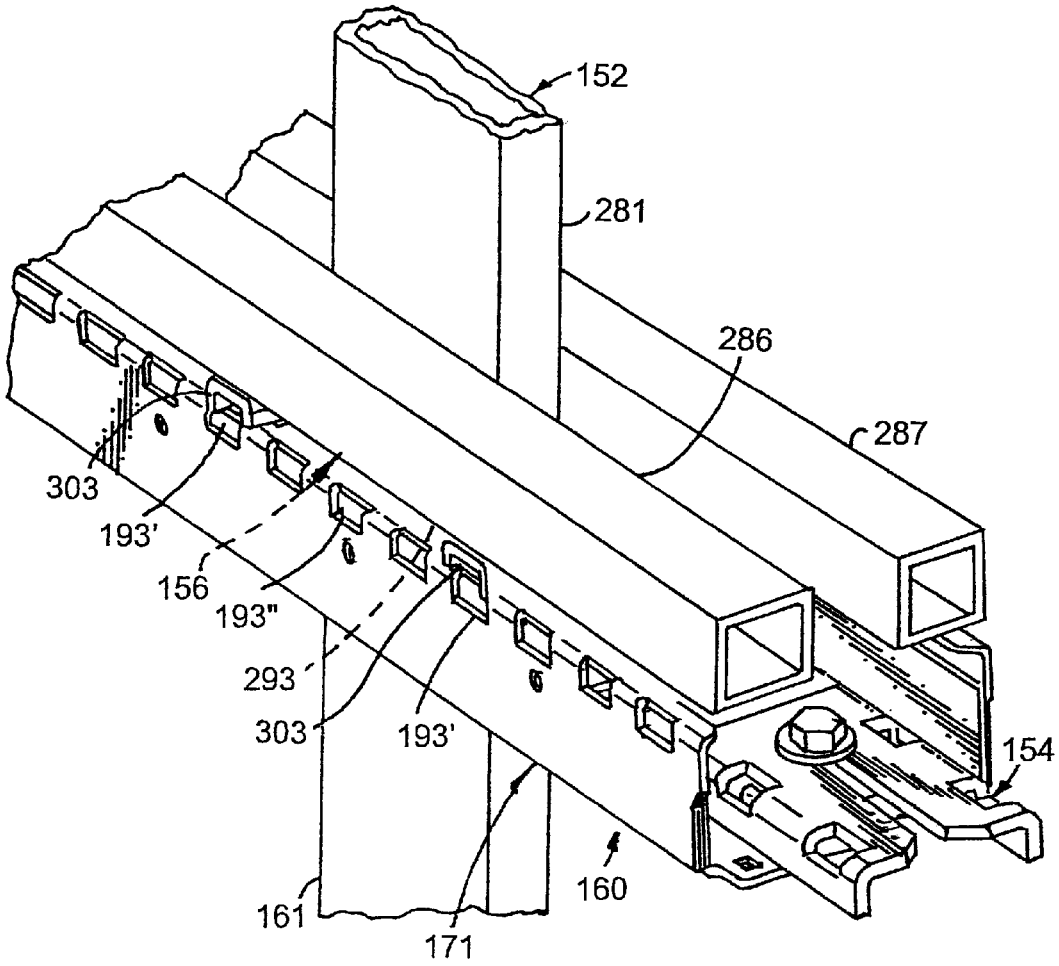
FIG. 53A is a fragmentary perspective view comparable to FIG. 53, but showing the bottom horizontal frame members of the top stacker frame and the top horizontal frame member of the bottom frame.

Stacking connectors 156 (FIG. 52–53A) each include a carrier bracket 292 and a pair of opposing clamping members or gripping members 294 and 294' slidably mounted on the carrier bracket 292. An actuator 293 operably engages the clamping members 294 and 294' to forcibly spread apart the clamping members into interlocking engagement with the selected aperture pattern 183. Notably, the present invention is contemplated to include other stacking connector designs, such as a stacking connectors constructed so that its clamping members are drawn together into engagement with outwardly facing apertures in a top frame member of a space frame.

In the present embodiment, the carrier bracket 292 (FIG. 52) is a stamped sheet metal part that includes a center flange 295 and a pair of inverted U-shaped locating flanges 296 and 297 extending from the longitudinal sides of center flange 295. An aperture 298 is formed in center flange 295, and tabs 299 and 300 extend upwardly from center flange 295 for slidably engaging and aligning clamping members 294 and 294' on carrier bracket 292. Locating flanges 296 and 297 each include notches 302 and tabs 303 at their front and rear ends for mateably engaging notches 191 and 192 in apertures 179' of aperture pattern 183. When carrier bracket 292 is positioned on top frame member 171, bracket center flange 295 is juxtaposed above center flange 172 of top frame member 171, and bracket tabs 303 interlockingly engage the apertures 179' in top frame member 171. Thus, stacking connector 156 can be selectively engaged with top frame member 171 at any of a plurality of different staggered interconnected positions (e.g., every 12 inches along the length of top frame member 171). This allows the vertical side edges 304 of stacking partition panel space frame 280 to be offset from the vertical side edges 305 of base partition panel space frame 160, in order to form a stronger stacked arrangement of panels (see FIG. 74).

Figure 54:
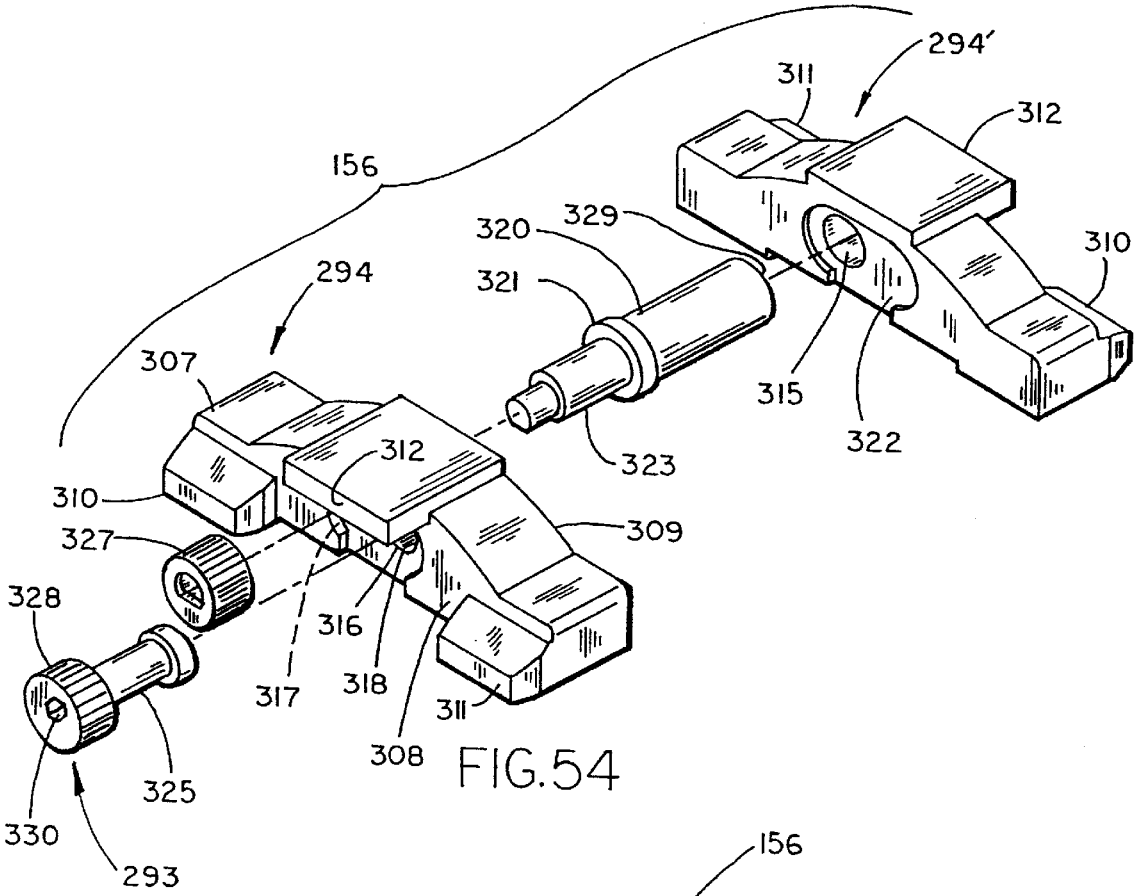
FIG. 54 is an exploded perspective view of the clamping members and clamping actuator for the stacking connector shown in FIG. 53.
Figure 55:
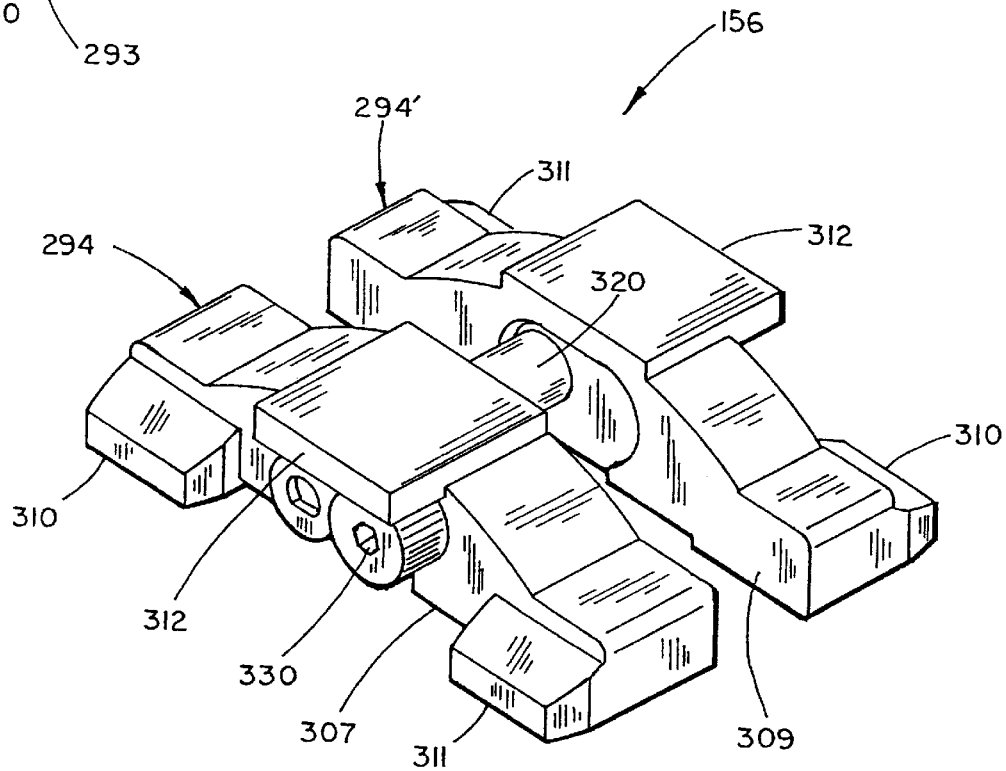
FIG. 55 is a perspective view comparable to FIG. 54, but with the clamping members and clamping actuator being shown in an assembled position.
Figures 58, 59:
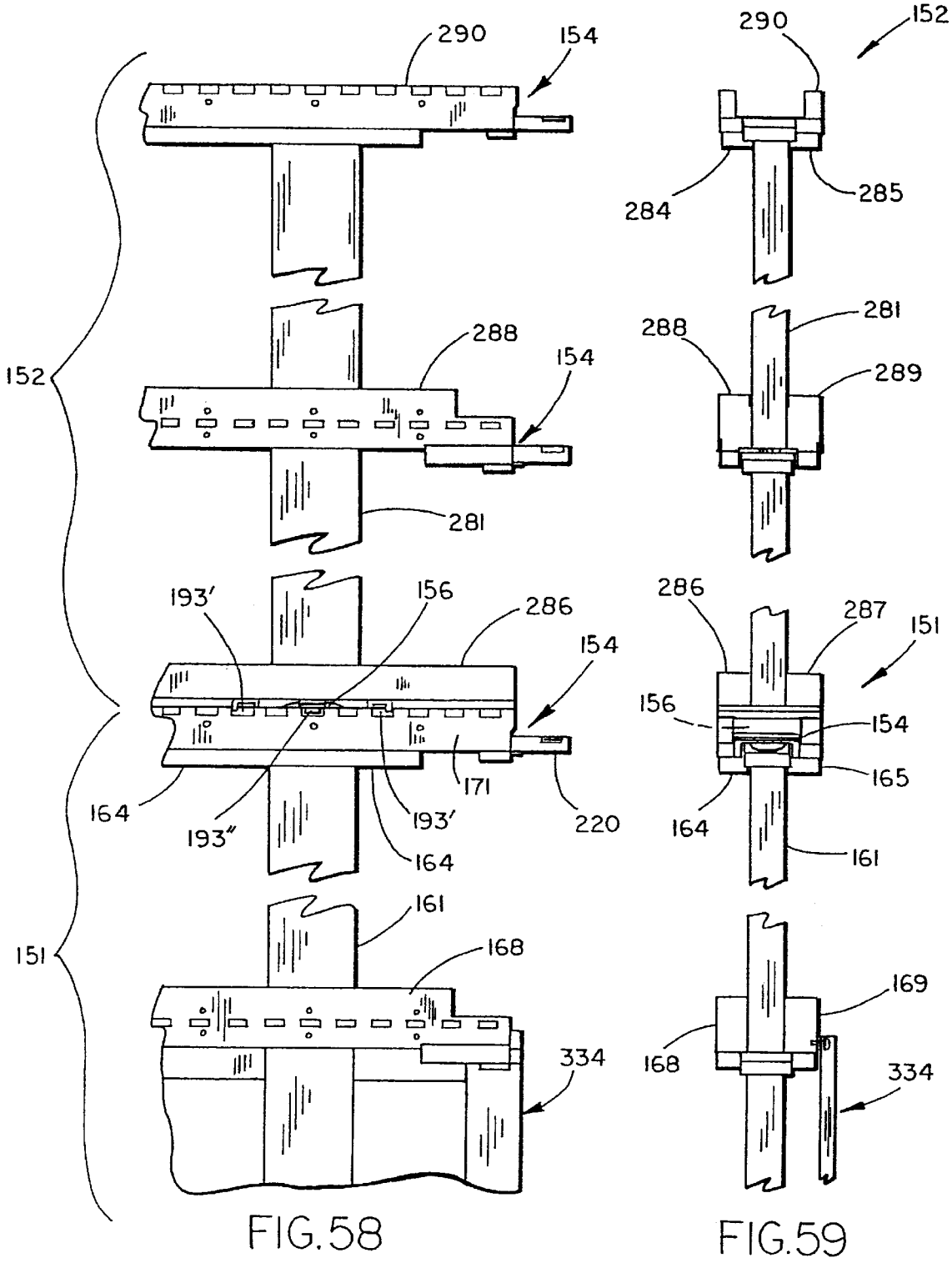
FIG. 58 is a fragmentary elevational view of a stacked assembly including a base partition panel and a stacking partition panel.
FIG. 59 is a fragmentary end view of the stacked assembly shown in FIG. 58.

Clamping members 294 and 294' are substantially mirror images of each other, except as described below. Clamping member 294 (FIG. 54) includes a body 307 having an outer surface 308 and an inner surface 309. A pair of lower fingers 310 and 311 extends from the outer surface 308 at the bottom thereof, and a centered upper finger 312 extends from the top of outer surface 308. Fingers 310–312 are configured to matingly engage apertures 187, 189, and 185, respectively, (FIG. 52) on one side of aperture pattern 183 in top frame member 171. The bottom surface of clamping member 294 is configured to slidably rest on and engage the center flange 172 of carrier bracket 292. An oblong aperture 316 having ends defining a pair of spaced-apart hole-like surfaces 317 and 318 extends horizontally through clamping member 294 from front to rear. A hole 315 extends horizontally through clamping member 294' and aligns with the hole-like surface 317 in clamping member 294'.

Actuator 293 includes an elongated nut 320 configured to matingly non-rotatingly engage hole 315. The nut 320 includes a washer-like flange 321 on its inner end configured to matingly engage a depression 322 on the inner surface of clamping member 294'. Actuator 293 further includes a first shaft 323 configured to threadably engage nut 320 for rotation therein. Shaft 323 also includes a portion that extends through the hole-like surface 317 in clamping member 294. A second shaft 325 operably engages the second hole-like surface 318 in clamping member 294. Intermeshing gears 327 and 328 are formed on the adjacent ends of shafts 323 and 325, respectively. Hex-shaped recesses 329 and 330 are formed in the rear end of shaft 323 and on the front end of shaft 325, respectively. The hex-shaped recesses 329 and 330 are engageable with an Allan wrench through apertures 193" (FIG. 52) to actuate actuator 293. Specifically, when one shaft is rotated by the Allan wrench, the other shaft is simultaneously oppositely rotated by the intermeshing gears 327 and 328. This causes the shaft 323 to gradually rotate out of nut 320, thus forcing the clamping members 294 and 294' apart. This causes fingers 310–312 to interlockingly engage apertures 185–190 of aperture pattern 183.

Figure 61:
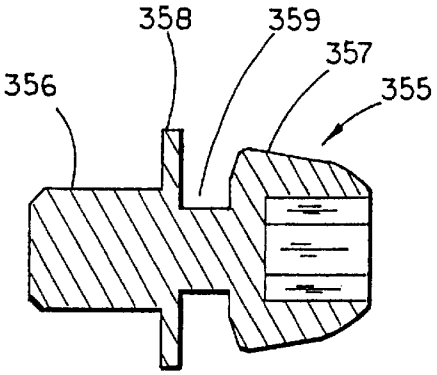
FIG. 61 is a side cross-sectional view of the cover support connector shown in FIG. 61.
Figure 60:
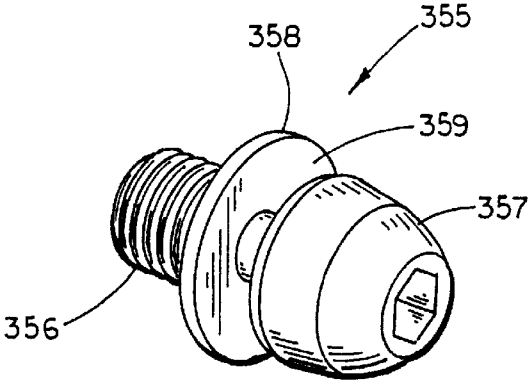
FIG. 60 is a perspective view of the cover support connector shown in FIG. 42.
Figure 62:
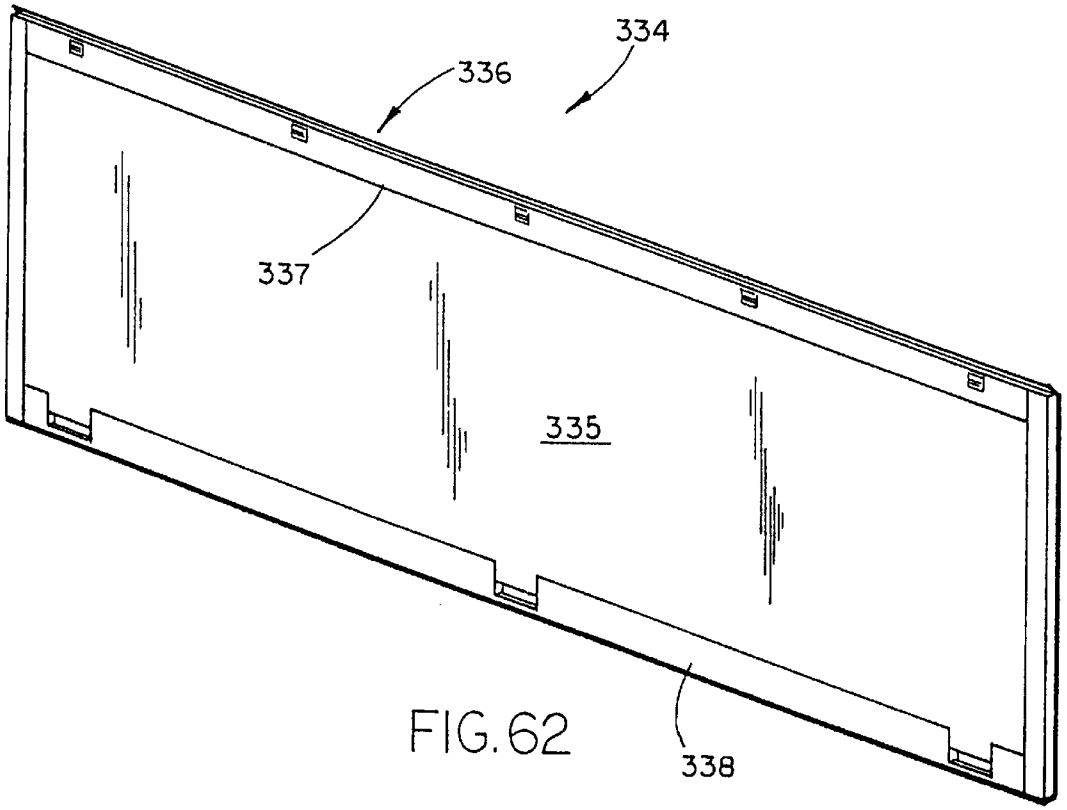
FIG. 62 is a perspective view of the interior side of a cover for covering a base panel.
Figure 67:
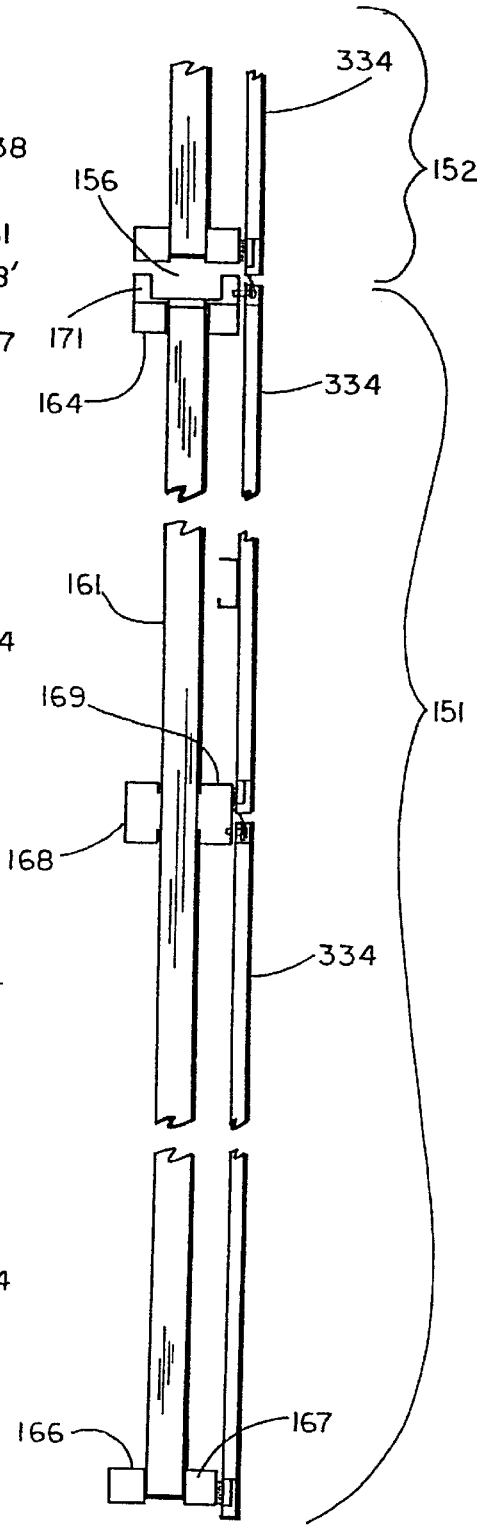
FIG. 67 is an elevational cross-sectional view of a stacked subassembly including a stacking panel, a base panel, and covers attached thereto.

Cover retainers 355 (FIGS. 60 and 61) are provided for securing covers 334 (FIG. 62) to base and stacking space frames 160 and 280. Retainers 355 include threaded shafts 356 for engaging holes 355' in horizontal structural frame members 168, 169, 171, and 230 (FIGS. 42 and 67). Retainers 355 (FIGS. 60 and 61) further include tapered heads 357 and washers 358 defining a recess/groove 359 therebetween.

Covers 334 (FIG. 62) are configured for attachment to cover retainers 355. Covers 334 include a sound-absorbing composite panel 335 aesthetically covered with upholstery or the like and having a selected size. A marginal frame 336 is attached to the edges of panel 335, including a top marginal frame section 337 (FIG. 63) and a bottom marginal frame section 338. The top marginal frame section 337 includes an inner flange 339, a top flange 340, and a front flange 341. A plurality of attachment apertures 342 and 343 is formed along top marginal frame section 337, apertures 342 being formed in inner flange 339, and apertures 343 being formed in top flange 340. A tab can be extended from inner flange 339 to outer flange 341, if desired, to assist in supporting front flange 341 relative to inner flange 339 and to stiffen top marginal frame section 337. Bottom marginal frame section 338 (FIG. 65) also includes an inner flange 345, a bottom flange 346, and an outer flange 347, and further includes apertures 348 formed in inner flange 345 at spaced intervals along the length of bottom marginal frame section 338. A pair of angled tabs 350 are formed inwardly from inner flange 345 to inner flange 347. Angled tabs 350 assist in supporting panel 335 within the bottom marginal frame section 338.

Covers 334 (FIGS. 67–70) are releasably secured to base space frame 160 and stacking space frame 280 by positioning the apertures 342 of top marginal frame sections 337 on the heads of several cover retainers 355. The material forming the aperture 342 is then slid downwardly into the recess 359 of cover retainer 355 (FIG. 60) so that the top marginal frame section 337 of the cover 334 is interlocked thereon (see FIGS. 67–70). The cover 334 is then rotated downwardly along direction "A" until the bottom marginal frame section 338 is located adjacent base space frame 160 (or 280). The bottom marginal frame section 338 is secured to base space frame 160 by patches of hook-and-loop material 360 (FIG. 67). A light shield 361 extends below bottom marginal frame section 338 to prevent unacceptable see-through along the gap 338' between upper and lower covers 334 and 334' on base space frame 160, and also in the gap between adjacent covers on stacking panel 152 and base panel 151. It is contemplated that the hook-and-loop material could be replaced with other retention systems, such as a tab and aperture system, snap-in carrot-like fasteners, adhesive, or other fasteners.

Figure 71:
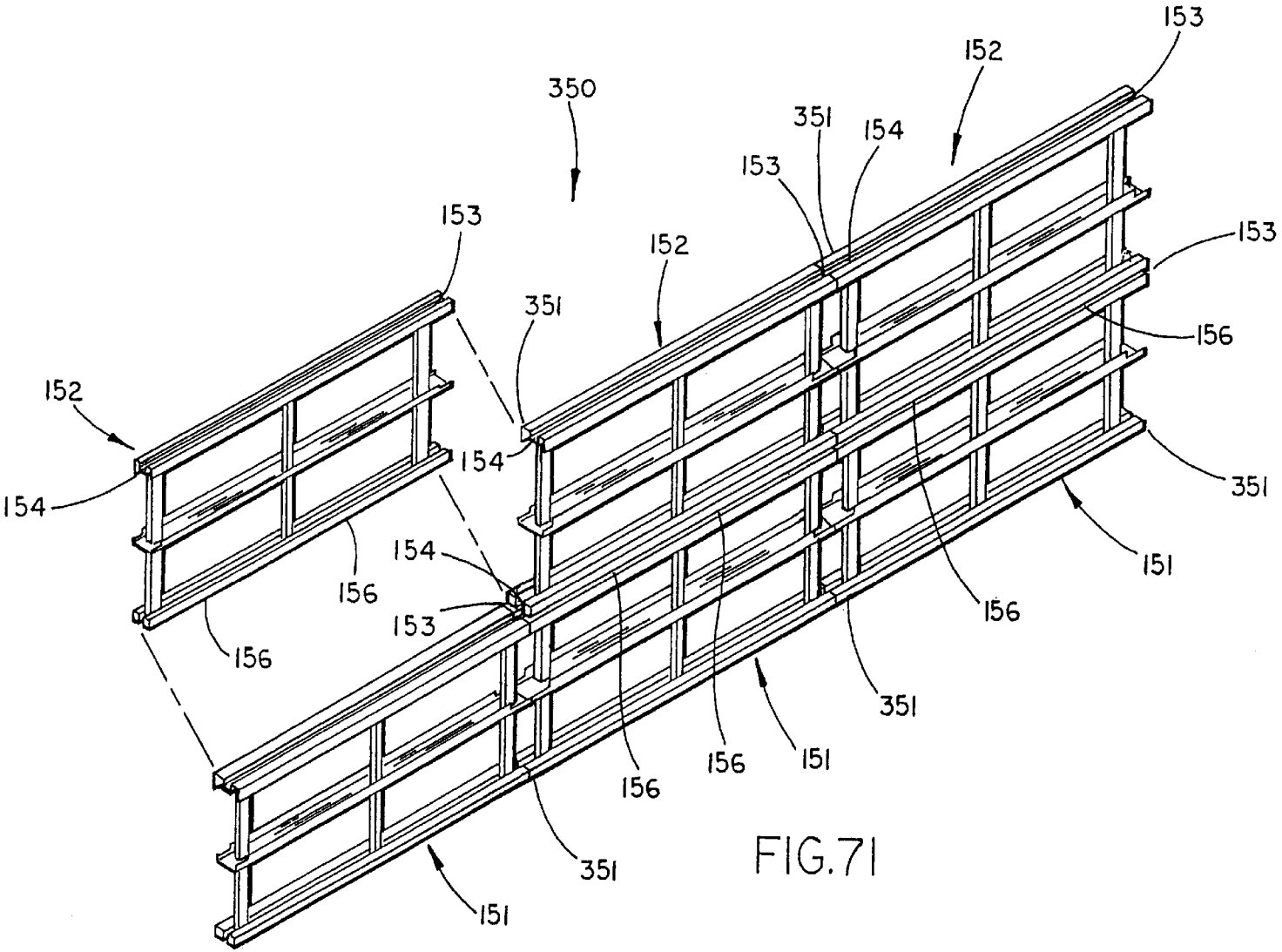
FIG. 71 is a perspective view showing a method of assembling a stacking panel to previously connected base partition panels and stacking partition panels in a wall construction.
Figure 72:
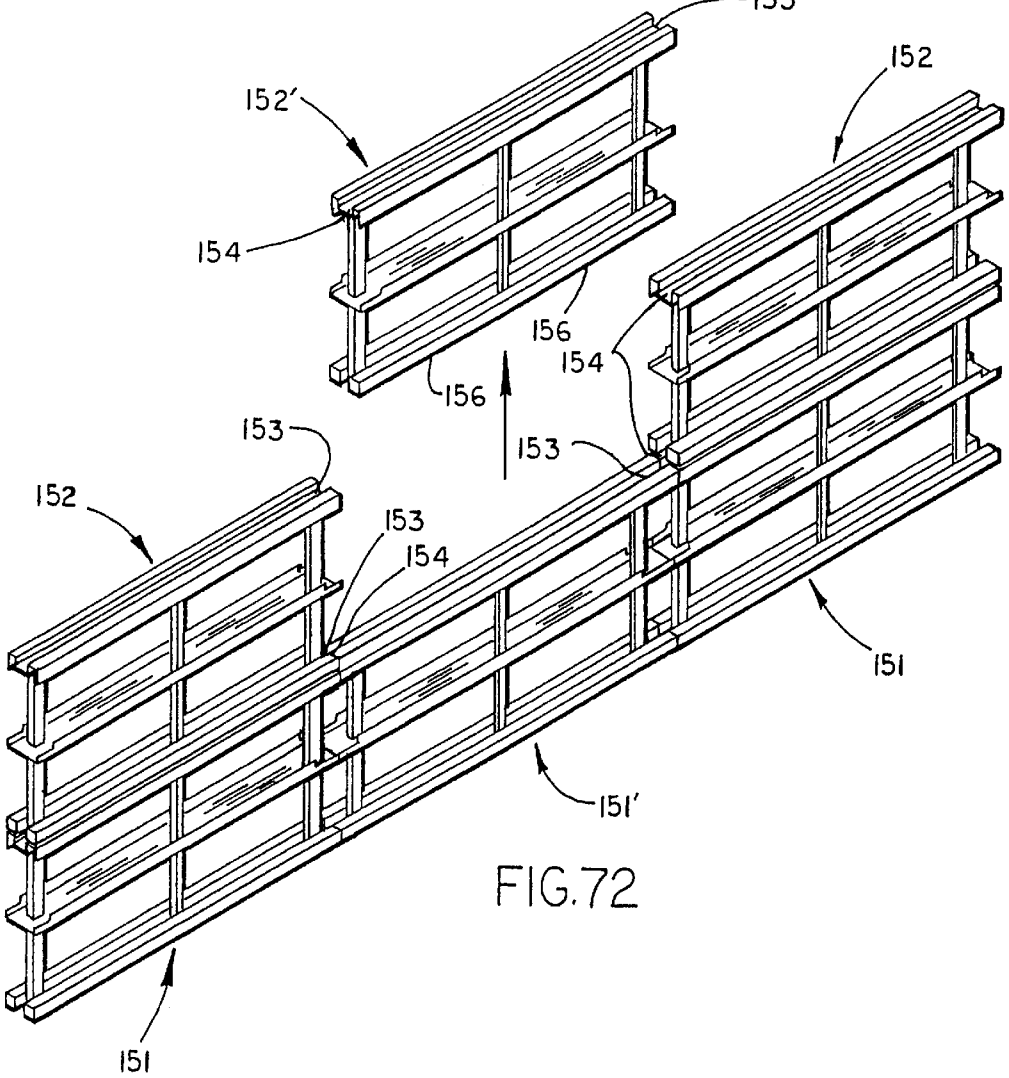
FIG. 72 is a perspective view showing a method of disassembling a stacking partition panel from between other partition panels in a wall construction in a non-progressive manner.
Figures 73, 74:
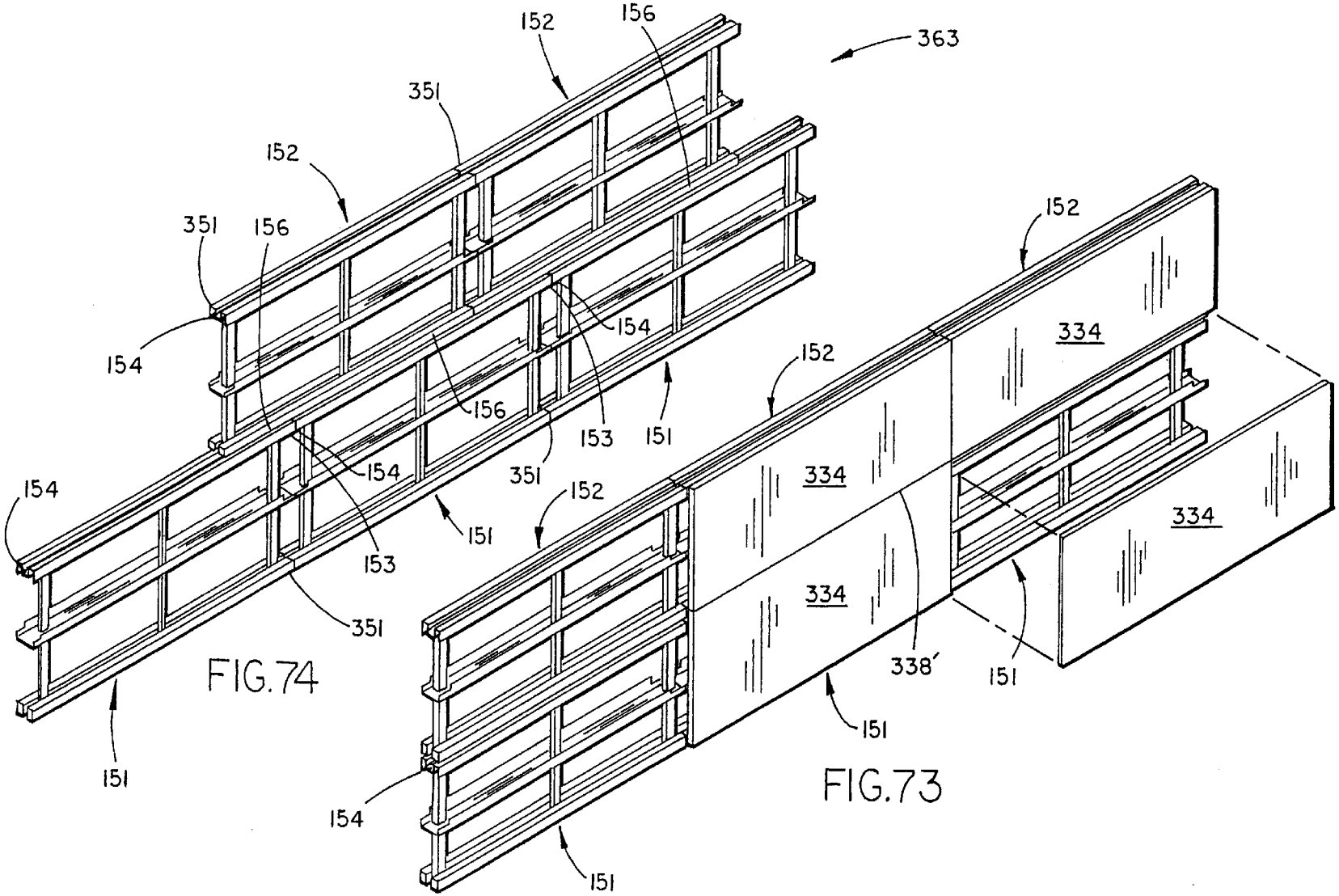
FIG. 73 is a perspective view showing a method of assembling covers to a wall construction of base partition panels and stacking partition panels.
FIG. 74 is a perspective view showing a method of assembling the stacking partition panels and the base partition panels in a staggered/alternating arrangement.

The base partition panels 151 and stacking partition panels 152 can be interconnected in a myriad of different arrangements by the in-line connectors 153 and 154, the off-module connectors 155, and the stacking connectors 156. FIG. 71 discloses a typical in-line wall construction 350 wherein the base partition panels 151 and stacking partition panels 152 are interconnected in an in-line arrangement. In wall construction 350, the vertical side edges 351 of the panels 151 and 152 are aligned. Recalling that the stacking connectors 156 are accessible through apertures 179 in the top frame member 171 of base partition panel 151, and that the in-line connectors 153 and 154 are accessible from the top of stacking partition panel 152, it will be noted that a particular stacking partition panel 152' positioned in the middle of wall construction 350 can be removed in a non-progressive disassembly by disengaging the stacking connectors 156 and the in-line connectors 153 and 154 (FIG. 72). Thereafter, the base partition panel 151' can also be removed by disengaging its in-line connectors 153 and 154. Thus, panels 151' and 152' can be replaced. Alternatively, the panels 151' and 152' can be "permanently" removed and a walkway through the panels can be created. Covers 334 (FIG. 73) are attached to the various partition panels 151 and 152 to aesthetically cover same. Notably, top and bottom covers 334 are spaced apart to form the gap 338' therebetween (FIG. 67). This allows access to apertures 179 along horizontal frame members 168, 169, 171, and 230 of space frames 160 and 280, such that stacking panels 152 can be removed without removing covers 334 from the stacking panels 152, thus reducing disassembly and reassembly time and also reducing the risk of damage to loose covers.

The stacking partition panels 152 can also be attached to base partition panels 151 in a staggered arrangement (FIG. 74) to form a wall construction 363, wherein the vertical side edges of the panels 151 and 152 are misaligned. The misalignment is accomplished by engaging stacking connectors 156 with selected aperture patterns 183 to position the stacking panel 152 offset from the base panel 151. Advantageously, this increases the strength of the wall construction 363 since there is no continuous vertical side edge formed by the staggered arrangement. In regard to wall construction 363 (see FIG. 34), which discloses a wall construction that is three sections high and staggered, the third section being a second stacking panel, a transom section, or an expressway section. Notably, the wall construction can be partial height or full height and/or connected to a structural ceiling or a drop ceiling.

Figure 34:
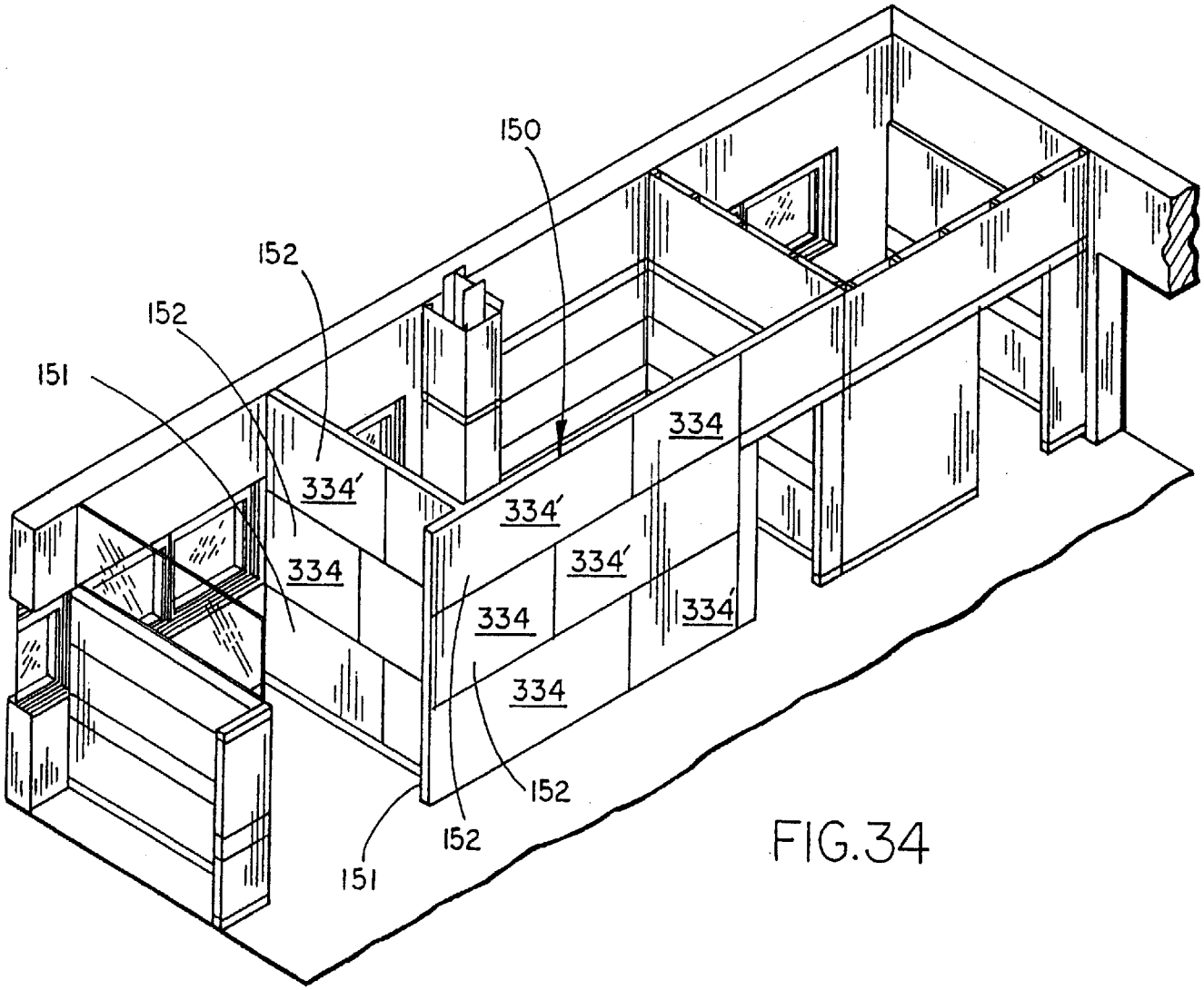
FIG. 34 is a perspective view of another integrated prefabricated partition system, which includes a partition panel system and a connection system embodying the present invention.
Figures 75, 76:
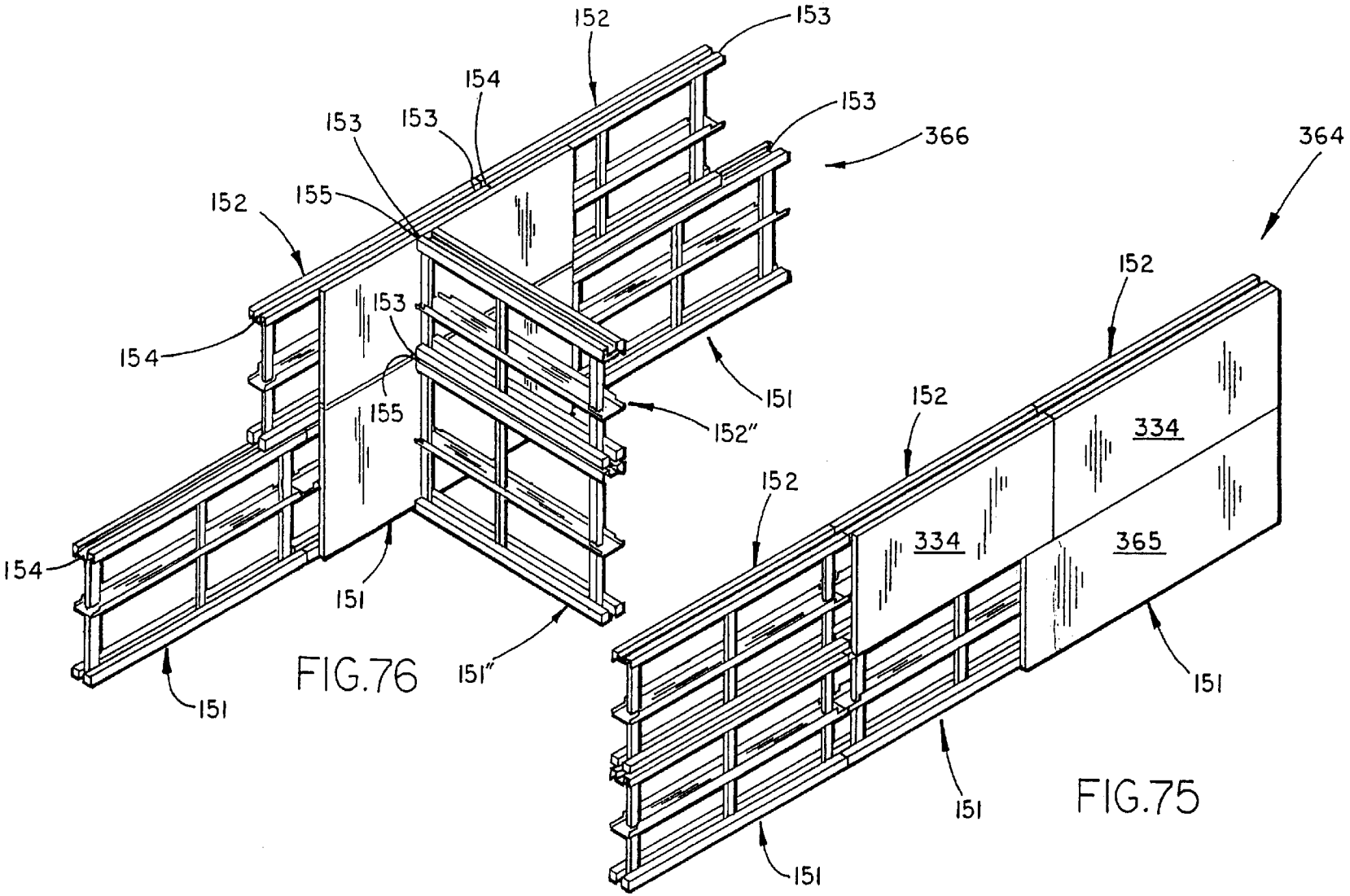
FIG. 75 is a perspective view showing a method of assembling the covers to a wall construction of interconnected base and stacking partition panels with the covers being staggered on the wall construction.
FIG. 76 is a wall construction including staggered base and stacking partition panels, off-module connected partition panels, and covers.

The covers can also be attached to the partition panels 151 and 152 in a staggered arrangement, as illustrated by cover 365 in FIG. 75 to form a wall construction 364, or as illustrated by covers 334' in FIG. 34. This allows covers of non-uniform length and spacing to be used on the wall constructions. For example, this can be advantageous for aesthetics since the vertical lines in a wall construction can be broken up. Also, the staggered arrangement of covers allows increased flexibility for design, since new combinations of colors and arrangement patterns can be achieved. Still further, the staggered arrangement offers advantages in terms of positioning covers to form gaps at strategic locations, such as for positioning of cabling and wiring modular outlets or for routing cabling and wiring therethrough, such as to an off-module connected wall section.

The wall construction 366 (FIG. 76) includes in-line connected base partition panels 151 and stacking partition panels 152 interconnected in a staggered arrangement, and further includes off-module base partition panel 151" and an off-module stacking partition panel 152" connected in an off-module T-shaped arrangement. Covers 334 are shown attached to the in-line connected wall section to show their relationship to the off-module connected wall section. Notably, the panels can be used to construct wall constructions having T, H, Z, or X-shaped plan configurations. Also, the panels can be constructed using stacking panels attached above other stacking panels. The above description of non-progressive removal is possible, even where both ends of a panel are connected with an off-module connection. (For example, see off-module constructed wall section in FIG. 34.)

A number of different floor-engaging constructions are contemplated. For example, a floor-engaging and kickway-forming member can be attached to the bottom of base panel space frame 160, such as the downwardly facing U-shaped channel shown in FIGS. 4 and 11 for forming the bottom kickway of base panel 151. Alternatively, relatively short leveling screws or leveling feet can be welded to the bottom of vertical tubes 161–163 as desired without incorporating a kickway-forming bracket thereon. Still another alternative is to attach an upwardly facing U-shaped channel to the floor, with the U-shaped channel being configured to mateably receive the bottom of the base panels 151 (or the leveling feet attached to base panels 151).

A floor-securement system 375 (FIGS. 77 and 78) has been developed that incorporates a modified version of the panel-mounted in-line connectors 153 and 154 to facilitate constructing a wall construction 376. Floor-securement system 375 includes a floor-engaging channel 380 having ends with mating in-line connectors 381 and 382 thereon that are not unlike in-line connectors 153 and 154. The channel 380 further includes apertured sidewalls 383 and 384 configured to receive off-module connectors 155 (FIG. 47). Floor-engaging channel 380 (FIG. 79) is constructed to securely engage base space frame 160 and, for this purpose, includes slidably movable interlock brackets 426 for releasably engaging leveling members 386. By retaining channel 380 to leveling members 386, the channels 380 can be shipped pre-assembled to panels 151 or shipped separate therefrom. Also, the panels 151, when assembled together, can be positively secured to the channels 380, and the channels 380 can be positively secured to the building floor, which provides a very positive construction having advantages, such as resistance to damage from earthquakes and other catastrophic events.

Floor-engaging channel 380 (FIG. 81) has a W-shaped cross section reminiscent of top frame member 171. Channel 380 is formed by a center flange 390, vertical intermediate side flanges 391 and 392, floor-engaging horizontal flanges 393 and 394, and vertical outer side flanges 383 and 384. Floor-engaging flanges 393 and 394 can be secured to a floor by adhesive, nails, and other ways known in the trade. Flanges 390–392 form a U-shaped section configured to slidably receive the extendable brackets 220 shown in FIG. 40 and previously described. A nut 397 is welded under a hole 398 near the end of center flange 390, and a screw 399 with a washer/enlarged head 400 thereon is configured to threadably engage nut 397 through hole 398. When screw 399 is loosened, bracket 220 is movable between an extended position and a retracted position. Screw 399 can then be screwed into nut 397 to clampingly retain bracket 220 in the selected position. When extended, bracket 220 can be mateably engaged by an end of an aligned and adjacent floor-engaging channel 382 with the corresponding screw 399 on the mating channel being positioned in slot 228 of bracket 200. In this aligned and adjacent position, the corresponding screw 399 in the adjacent channel can be screwed into its nut to clampingly retain the bracket 220, thus securing the adjacent channels 380 in an aligned and interconnected position. Notably, it is contemplated that the nut 397 will be welded to center flange 390, although a cinch plate could be used like the in-line connectors 153 and 154, if desired.

Figure 48:
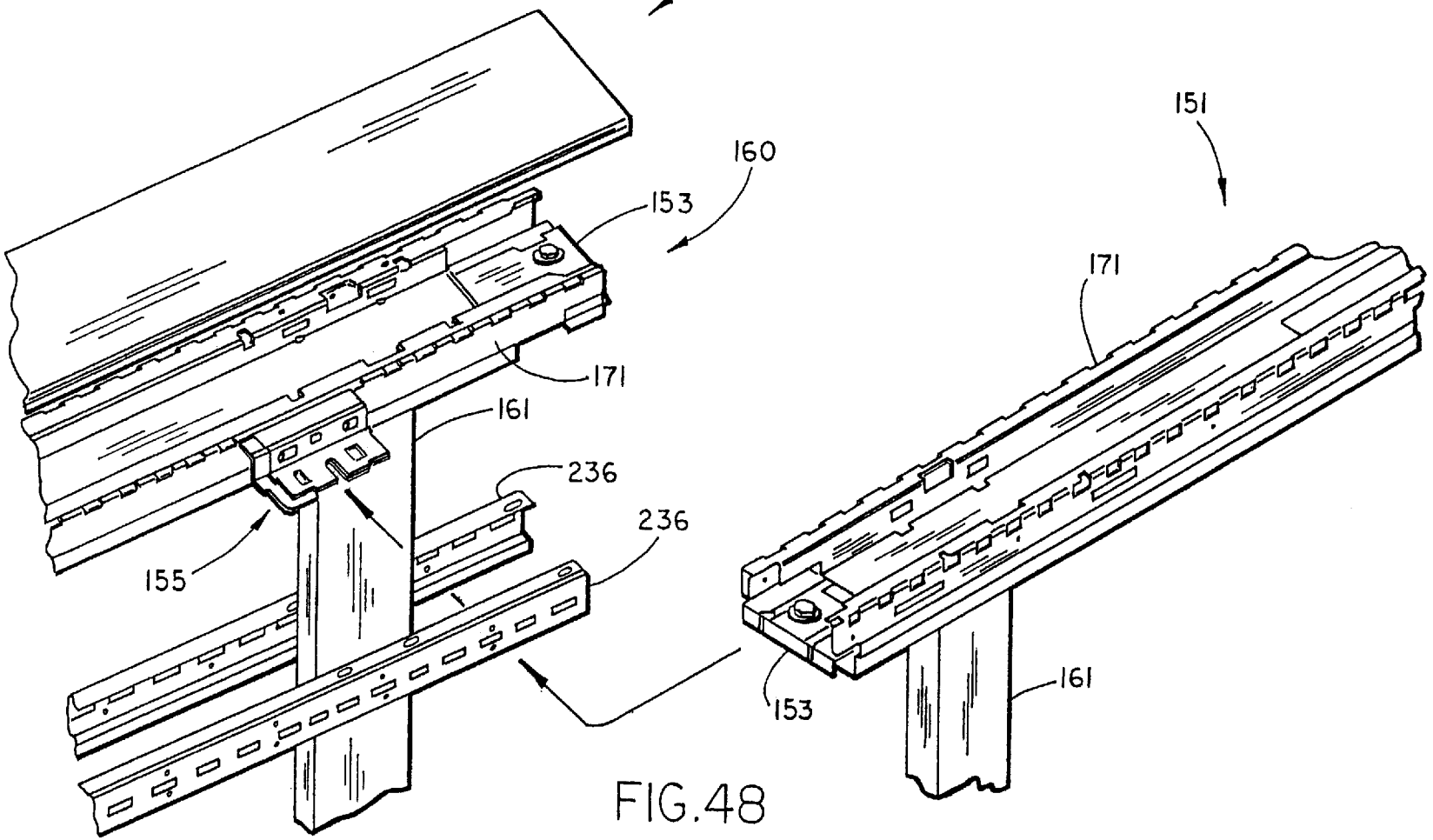
FIG. 48 is a perspective view of the off-module connector attached to a first partition panel at an intermediate location between the vertical side edges of the first partition panel, the off-module connector being positioned to matingly receive and engage an in-line connector on a second partition panel for interconnecting the second partition panel to the first partition panel in an off-module position.
Figure 81:
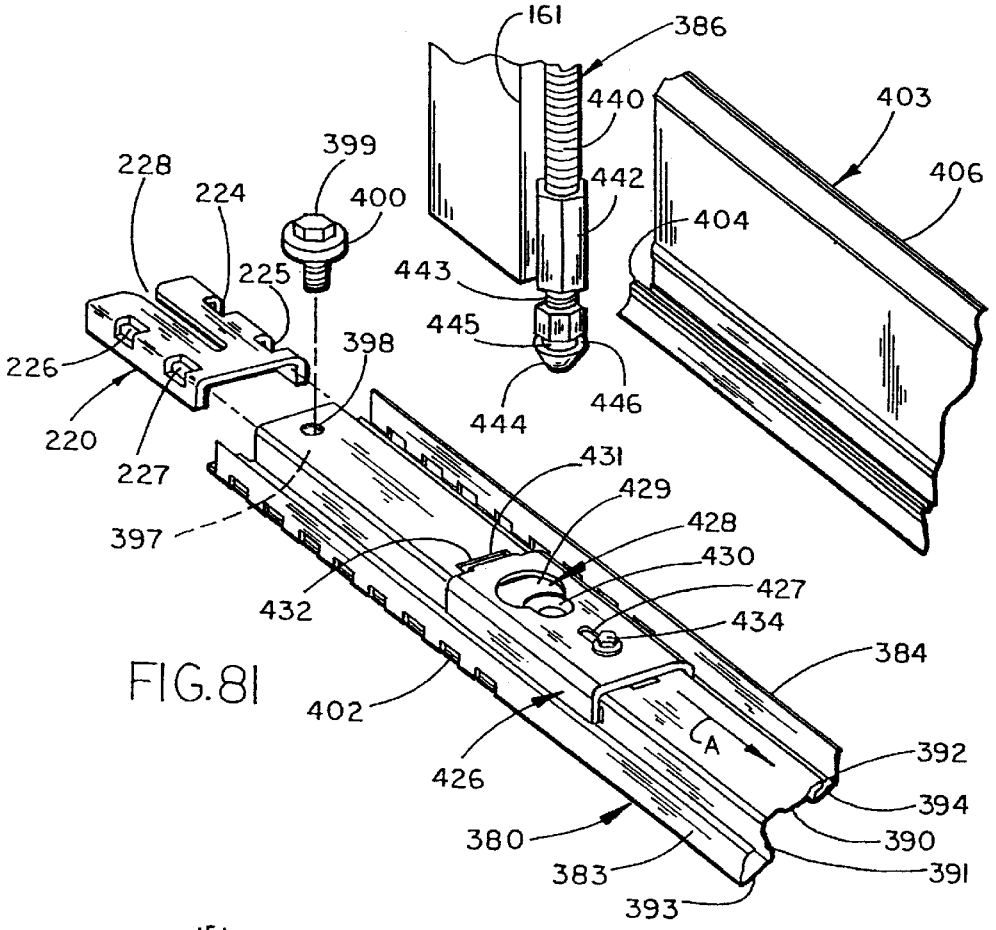
FIG. 81 is an exploded perspective view of the leveling screws and the floor-engaging channel shown in FIGS. 79 and 80.

Side flanges 383 and 384 each includes a row of apertures 402 positioned generally along the lowermost edge of side flanges 383 and 384 (FIG. 81). The apertures 402 generally correspond to the apertures 179 on top rail member 171 (FIGS. 37 and 48). Apertures 402 (FIG. 81) are engageable by off-module bracket 155 (FIG. 47) by inverting the off-module bracket 155, so that teeth 250 and 261 can be engaged with apertures 402 (FIG. 81) with off-module bracket 155 engaged with selected apertures 402, the apertured flanges 252 and 262 (FIG. 46) extend laterally and are located above the floor where they are engageable by an in-line connector 381 on an off-module connected channel 380.

Figure 83:
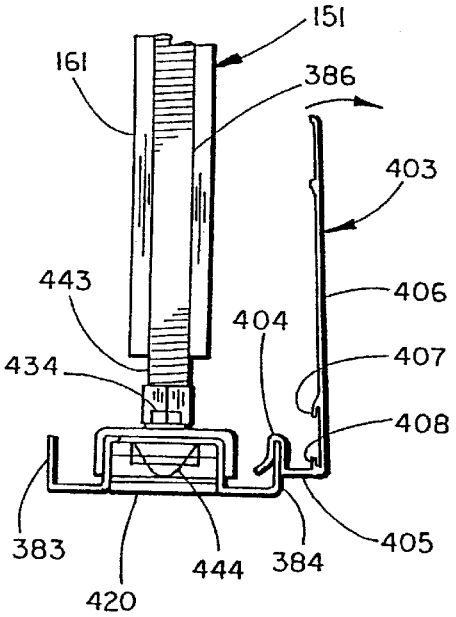

A kickway cover 403 (FIG. 83) is configured for use with channel 380. Kickway cover 403 includes a resilient clip-like end 404 configured to clip attach to the top of side flange 383 (or 384). Kickway cover 403 further includes a horizontally extending lower leg 405 that spaces a vertical extending upper leg 406 from side flange 383. Upper leg 406 is biased inwardly by clip-like end 404 (FIG. 83) so that when a panel cover 334 (FIG. 80) is attached to the base panel 151, upper leg 406 presses against the panel cover 334. The inner surface of upper leg 406 includes hook-like features 407 and 408 for receiving tabs on an end cover for the kickway on an end panel. Notably, like panel covers 334, kickway covers 403 can bridge or span between adjacent base panels 151.

Figure 82:
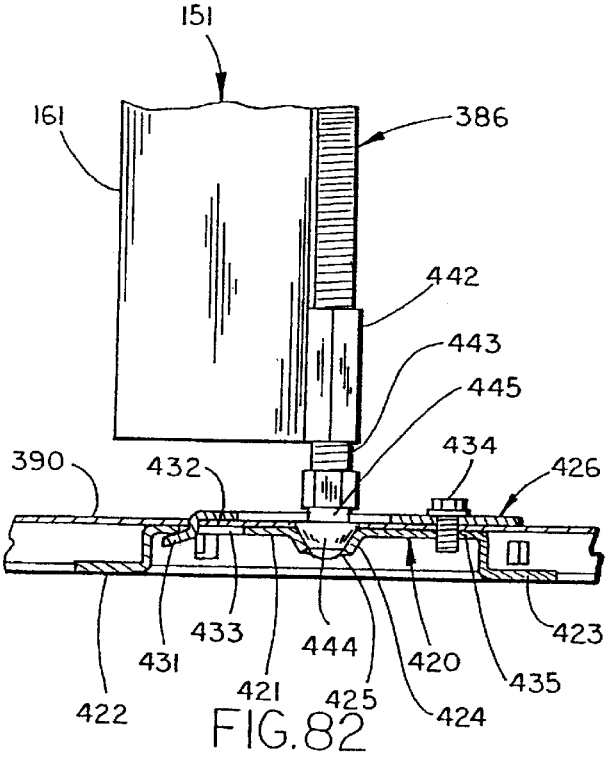
FIGS. 82 and 83 are fragmentary side and end views showing the interconnection of the leveling screws on the base panel to the floor-engaging channel.

Floor-engaging channel 380 (FIG. 82) includes a plurality of support brackets 420 positioned under center flange 390 at locations generally corresponding to the predetermined locations of leveling members 386 on base panel 151. Support brackets 420 each include a platform 421 supported by floor-engaging feet 422 and 423. Platform 421 includes a leveler receiving hole 425 defined by a frustoconically-shaped annular flange 424. A U-shaped interlock bracket 426 is slidably positioned on center flange 390 above platform 421. Interlock bracket 426 includes a longitudinally extending slot 427 (FIG. 81) and a keyhole slot 428 having an enlarged end 429 and a smaller end 430. Interlock bracket 426 includes a retention tab 431 engageable with an aperture 432 in center flange 390 and in aligned aperture 433 in platform 421. A bolt 434 is extended through slot 427 threadably into a threaded hole 435 (FIG. 82) in platform 421. Bolt 434 cooperates with tab 431 to secure interlock bracket 426 to channel 380. Interlock bracket 426 is movable in direction "A" (FIG. 81) to a first position wherein the enlarged end 429 of interlock bracket 426 is aligned with frustoconically-shaped hole 425 on platform 421. Interlock bracket 426 is further slidably movable to a second position wherein the smaller end 430 of keyhole slot 428 is aligned with frustoconically-shaped hole 425.

Leveling member 386 (FIG. 81) includes a vertically disposed rod 440 welded to a vertical frame member, such as frame member 161 on panel 151. A threaded nut 442 is welded to rod 440, and a threaded rod section 443 is operably engaged with nut 442 and extended therebelow. The lower end 444 of threaded rod 443 is tapered to mateably engage frustoconically-shaped hole 425 and has a diameter permitting it to slide through the enlarged end 429 of keyhole slot 428. The lower end 444 includes a narrowed section 445 with back surface 446 that is interlockingly engageable with the smaller end 430 of keyhole slot 428.

Initially, the interlock bracket 426 is moved to the first position, so that the enlarged end 429 of keyhole slot 428 aligns with frustoconically-shaped hole 425. A panel 151 is then placed in floor-engaging channel 380 with the tapered lower end 444 of leveler 386 mateably engaging frustoconically-shaped hole 425 of platform 421. Interlock bracket 426 is then slid to the second position so that the smaller end 430 of keyhole slot 428 is aligned with frustoconically-shaped hole 425. In this position, interlock bracket 426 engages the back surface 446 on tapered lowered end 444 to interlockingly retain the base panel 151 to channel 386.

This arrangement has several advantages. The arrangement permits pre-assembly of channel 386 to base panels 151, which can be advantageous for shipping, but also optionally allows the channels 386 to be shipped separately and assembled on-site. Further, whether it is pre-assembled or assembled on-site, the channel can be interlocked to securely retain panels 151 to channel 386. This has significant value, not only to facilitate installation but also for resisting damage from earthquakes, for meeting "earthquake codes," and for resisting damage from other catastrophic events.

Thus, a wall construction is illustrated including base partition panels and stacking partition panels, interconnectable with in-line connectors, off-module connectors, and stacking connectors. The wall construction is connectable and reconfigurable in a variety of in-line and off-module connected arrangements, and in a variety of vertically aligned and staggered/misaligned arrangements.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A method for attaching a furniture unit to a partition having a frame with a horizontal row of slots, comprising the steps of:

providing a bracket having a hook constructed for insertion into a selected one of the slots in the horizontal row of slots of the partition, the hook being configured to move horizontally between an installation position and an interlocked position;

selectively inserting the hook into a selected one of the slots in the horizontal row of slots of the partition with the hook being positioned in the installation position;

moving the hook horizontally/laterally to the interlocked position;

attaching the bracket to the furniture unit; and securing the hook in the interlocked position;

wherein the step of attaching the bracket to the furniture unit is performed after the step of inserting the hook into the selected one of the slots in the partition.

2. A method of connecting partition panels comprising steps of:

providing a first partition panel including a partition frame having upper and lower horizontal frame members, at least one of which includes a horizontal row of horizontally spaced and aligned discrete site locators, including at least one discrete site locator positioned between vertical side edges of the partition frame, the discrete site locators being configured and adapted to locate an off-module-located second partition panel along the partition frame at any one of a number of known locations characteristically without the need to measure to accurately locate the second partition panel;

accurately locating the off-module-located second partition panel on the first partition panel relative to a selected one of the discrete site locators;

providing partition-supporting brackets configured to selectively register on selected ones of the discrete site locators; and selectively registering the partition-supporting brackets on selected ones of the discrete site locators.

3. The method defined in claim 2, wherein the step of selectively registering includes disconnecting the partition-supporting brackets, relocating the partition-supporting brackets along the at least one frame member, and re-engaging the partition-supporting brackets at newly selected ones of the discrete site locators.

4. The method defined in claim 3, including a third partition panel aligned with and connected to the first partition panel, and wherein the discrete site locators are regularly spaced a unitary distance apart along a full length of the at least one frame member and across a full length of the third partition panel, and including a step of relocating the second partition panel to a location adjacent the third partition panel.

5. The method defined in claim 4, wherein the upper and lower frame members both include the discrete site locators, and the partition-supporting brackets include first and second brackets registering on the discrete site locators of the upper and lower frame members, and including attaching the first and second brackets to the upper and lower frame members.

6. The method defined in claim 5, wherein the discrete site locators are structural and configured and adapted to provide structural attachment to the partition frame by the partition-supporting brackets, and wherein the step of accurately locating includes attaching the partition-supporting brackets selectively to the discrete site locators for structural support.

7. The method defined in claim 6, wherein the discrete site locators comprise apertures in the partition frames, wherein the partition-supporting brackets include protrusions constructed to fit mateably into the apertures, and wherein the step of accurately locating includes extending the protrusions into selected ones of the apertures.

8. The method defined in claim 2, wherein at least some of the partition-supporting brackets are configured to engage the discrete site locators above an upper edge of the cover panel, and wherein the step of accurately locating includes extending the protrusions into selected ones of the discrete site locators above the upper edge.

9. The method defined in claim 2, wherein the first partition panel includes vertically spaced covers defining a slit therebetween, the slit providing access to the horizontally spaced and aligned discrete site locators during the step of accurately locating.

10. The method defined in claim 2, wherein the partition-supporting brackets are configured to frictionally and securely engage the discrete site locators, and the step of accurately locating includes securely engaging the brackets on selected ones of the discrete site locators.

11. The method defined in claim 10, wherein the partition-supporting brackets include at least one hook, and including a step of extending the hooks into a selected one of the discrete site locators.

12. The method defined in claim 11 wherein the partition-supporting brackets includes a pair of opposing hooks movable in opposite directions, and the step of accurately locating includes moving the opposing hooks in opposite directions.

13. The method defined in claim 2, wherein the upper and lower horizontal frame members each includes one of the horizontal rows of discrete site locators, and including engaging top and bottom partition-engaging brackets on the first and second partition panels, respectively, to stabilize the second partition panel on the first partition panel.

14. A method of attaching furniture components to an existing partition having a horizontal row of slots that extend along a horizontal/lateral direction parallel a face of the existing partition, comprising steps of:

providing bracketry having hooks movable between an installation position where the hooks define a compact shape permitting selective insertion into the horizontal row of slots in the existing partition, and an interlocked position where the hooks define a modified shape for securely engaging selected ones of the slots;

positioning the bracketry for insertion including moving the hooks to the installation position, manipulating the bracketry to orient the hooks, and inserting the hooks into engagement with selected ones of the slots;

moving the hooks in a horizontal/lateral direction parallel the face of the existing partition to the interlocked position; and fixing the hooks in the interlocked position.

15. The method defined in claim 14, including providing a furniture unit having a vertical side edge and attaching an end of the bracketry opposite the hooks to the vertical side edge of the second partition.

16. The method defined in claim 14, wherein the bracketry includes sliding plates and the hooks include oppositely facing hooks on the plates that move relative to each other when the plates are slidingly moved between the installation position and the interlocked position, and wherein the step of moving the hooks includes moving the hooks in opposite horizontal directions that are parallel the face of the existing partition.

17. The method defined in claim 16, wherein the step of fixing includes clamping the plates together to prevent sliding.

18. The method defined in claim 17, wherein the bracketry includes a threaded fastener, and wherein the step of fixing the bracketry includes extending the threaded fastener through the plates to secure the plates together.

19. A method of attaching an adjustable partition to an existing partition, where the existing partition defines a horizontal row of slots that extend horizontally/laterally across the existing partition, comprising:

providing brackets with hooks configured to engage selected ones of the slots;

attaching the brackets to the existing partition by engaging the hooks in selected slots at a selected location along the horizontal row of slots that is between vertical side edges of the existing partition;

providing the adjustable partition, the adjustable partition having a vertical side edge;

positioning the vertical side edge of the adjustable partition against a face of the existing partition at the selected location; and attaching the brackets to the vertical side edge of the adjustable partition with the hooks facing horizontally/laterally in opposite directions, whereby the adjustable partition is securely attached and accurately positioned at the selected location.

20. The method defined in claim 19, wherein the brackets include first and second bracket members, each having at least one hook.

21. The method defined in claim 20, wherein the first and second bracket members are slidably interconnected.

22. A method for attaching a furniture unit to a partition having a frame with a horizontal row of slots, comprising the steps of:

providing a bracket having a hook constructed for insertion into a selected one of the slots in the horizontal row of slots of the partition, the hook being configured to move horizontally between an installation position and an interlocked position;

selectively inserting the hook into a selected one of the slots in the horizontal row of slots of the partition with the hook being positioned in the installation position;

moving the hook horizontally/laterally to the interlocked position;

attaching the bracket to the furniture unit; and securing the hook in the interlocked position.

23. The method defined in claim 22, wherein the step of securing includes providing a second bracket having a protrusion, and including a step of attaching the second bracket to the furniture unit so that the protrusion prevents removal of the hook from the interlocked position.

24. The method defined in claim 23, wherein the protrusion comprises a second hook, and wherein the step of securing includes securing the first-mentioned hook and the second hook in opposing directions.

25. The method defined in claim 22, wherein the hook defines a thin vertical dimension so that the hook is constructed to be inserted through a thin vertical gap between vertically adjacent cover panels on the frame of the partition, and wherein the step of inserting the hook includes inserting the hook through the thin vertical gap.

26. A method for attaching a furniture unit to a partition having a frame with a horizontal row of slots, comprising the steps of:

providing a bracket having a hook constructed for insertion into a selected one of the slots in the horizontal row of slots of the partition, the hook being configured to move horizontally between an installation position and an interlocked position;

selectively inserting the hook into a selected one of the slots in the horizontal row of slots of the partition with the hook being positioned in the installation position;

moving the hook horizontally/laterally to the interlocked position;

attaching the bracket to the furniture unit; and securing the hook in the interlocked position;

wherein the bracket includes a pair of slidably interconnected bracket members, and the step of inserting includes moving the bracket members relative to each other to the installation position.

27. The method defined in claim 26, wherein the first bracket member includes the first-mentioned hook and the second bracket member includes second hooks, the first and second hooks facing in horizontally opposite directions.

* * * * *